US008010005B2

(12) United States Patent
Sukesako et al.

(10) Patent No.: US 8,010,005 B2
(45) Date of Patent: Aug. 30, 2011

(54) IMAGE FORMING APPARATUS

(75) Inventors: Masaki Sukesako, Kawasaki (JP); Nobuyuki Koinuma, Yokohama (JP); Kazuhisa Sudo, Kawasaki (JP); Kazuhiko Yuki, Kawasaki (JP); Hiroaki Takahashi, Atsugi (JP); Takehide Mizutani, Sagamihara (JP); Ryuji Yoshida, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 400 days.

(21) Appl. No.: 12/367,003

(22) Filed: Feb. 6, 2009

(65) Prior Publication Data

US 2009/0196638 A1 Aug. 6, 2009

(30) Foreign Application Priority Data

Feb. 6, 2008 (JP) ..... 2008-026923

(51) Int. Cl.
*G03G 15/16* (2006.01)

(52) U.S. Cl. ..... 399/66; 399/45; 399/314

(58) Field of Classification Search ..... 399/45, 399/66, 314

See application file for complete search history.

(56) References Cited

U.S. PATENT DOCUMENTS

| | | | | |
|---|---|---|---|---|
| 5,903,798 | A * | 5/1999 | Yokogawa et al. | 399/66 |
| 2002/0127025 | A1 * | 9/2002 | Sasai | 399/66 |
| 2004/0258430 | A1 * | 12/2004 | Ishii et al. | 399/89 |

FOREIGN PATENT DOCUMENTS

| | | |
|---|---|---|
| JP | 3-198079 | 8/1991 |
| JP | 3-231767 | 10/1991 |
| JP | 3503926 | 12/2003 |
| JP | 2005-156903 | 6/2005 |
| JP | 2005-156904 | 6/2005 |
| JP | 2005-164852 | 6/2005 |
| JP | 2005-195635 | 7/2005 |
| JP | 2007-57853 | 3/2007 |

* cited by examiner

*Primary Examiner* — Ryan D Walsh

(74) *Attorney, Agent, or Firm* — Oblon, Spivak, McClelland, Maier & Neustadt, L.L.P.

(57) ABSTRACT

An image forming apparatus includes a transfer device, a voltage applicator, a current sensor, and a discharge detector. The transfer device transfers a toner image from one surface to another by developing an electrical field across a transfer gap when provided with a transfer bias. The voltage applicator applies a stepped test voltage to the transfer device. The current sensor senses a current flowing to the transfer device during application of the test voltage the discharge detector detects an electrical discharge occurring in the transfer gap based on a rate of increase of the sensed current.

19 Claims, 13 Drawing Sheets

IMAGE FORMING APPARATUS

CROSS-REFERENCE TO RELATED APPLICATIONS

The present patent application claims priority pursuant to 35 U.S.C. §119 from Japanese Patent Application No. 2008-026923 filed on Feb. 6, 2008, the contents of which are hereby incorporated by reference herein in their entirety.

BACKGROUND OF THE INVENTION

1. Field of the Invention

The present invention relates to an electrophotographic image forming apparatus, and more particularly, to an image forming apparatus incorporating a transfer bias optimizer that optimizes an electrical transfer bias used to transfer a toner image in electrophotographic imaging processes.

2. Discussion of the Background

In electrophotography, images developed with toner particles are transferred from one medium to another during several imaging processes. Many electrophotographic image forming apparatuses employ transfer devices to transfer toner images across a transfer nip or gap, in which a biasing member, such as a roller, brush, or corona electrode, provided with an electrical transfer bias, develops a transfer field that induces toner particles to move, or transfer, to correct locations on an intermediate belt or a sheet of paper.

A good image is obtained with a high density of toner and a high transfer rate at which toner transfers from one surface to another, which in turn is highly dependent on the transfer field developed with the transfer bias.

For example, with too low a bias voltage applied to the biasing member, the resulting transfer field is too weak to attract toner particles. On the other hand, too high a bias voltage makes too strong a transfer field that induces an electrical discharge in the transfer nip. In either case, an inappropriate transfer field reduces transfer rate and density of toner in resulting images. In particular, the electrical discharge in the transfer nip is known to disturb transfer of toner, and can cause "reverse transfer", in which toner that has been transferred from an upstream photoconductor retransfers to a downstream photoconductor during sequential transfer of toner to a single receiving surface.

Thus, ensuring good image quality requires optimizing the transfer bias to obtain an appropriate transfer field. However, such optimization is difficult to achieve since the transfer bias is sensitive to variations in operating conditions, such as temperature and humidity, resistance of recording sheets, charge amounts of toner, and settings of specific print jobs.

Various techniques have been proposed to enhance transfer performance in image forming apparatuses.

Some conventional image forming apparatuses adjust conditions for printing according to actual transfer rates measured for toner images of a given test pattern. One such method forms a test image on a photoconductor drum, transfers it to a substrate, and adjusts print settings based on density of toner remaining on the photoconductor after transfer. Another method measures density of a test image on a photoconductor before and after transfer to an intermediate transfer belt, compares the measured densities, and adjusts electrical charges applied to the intermediate transfer belt based on the comparison results.

Designed to stabilize transfer rate at relatively low transfer bias voltages, these conventional methods do not account for effects of an excessive transfer bias on transfer performance, and therefore, cannot prevent image degradation due to an electric discharge occurring in the transfer gap. In this regard, several methods have been proposed for detecting occurrence of an electric discharge in a development nip defined between a photoconductor and a developer applicator during development of an electrostatic latent image.

For example, one conventional developing device detects an electrical discharge in a development nip by sensing a current flowing between electrodes submerged in developer upon voltage application, and adjusts agitation of the developer according to the detection results. Another conventional developing device measures density of a test image developed on a photoconductor to detect occurrence of an electrical discharge in a development nip, and adjusts a bias applied to move developer across the development nip.

Unfortunately, these detection techniques are designed for use in developing devices, and cannot be applied to the detection of an electrical discharge during transfer of developed toner images. Hence, what is needed is a transfer bias control system that can effectively optimize a transfer bias to provide a high transfer rate while still preventing electrical discharges in transferring toner images across a transfer gap.

SUMMARY OF THE INVENTION

Exemplary aspects of the present invention are put forward in view of the above-described circumstances, and provide a novel image forming apparatus that can optimize a transfer bias used to transfer a toner image across a transfer gap.

In one exemplary embodiment, the novel image forming apparatus includes a transfer device, a voltage applicator, a current sensor, and a discharge detector. The transfer device transfers a toner image from one surface to another by developing an electrical field across a transfer gap when provided with a transfer bias. The voltage applicator applies a stepped test voltage to the transfer device. The current sensor senses a current flowing to the transfer device during application of the test voltage The discharge detector detects an electrical discharge occurring in the transfer gap based on an rate of increase of the sensed current.

The present invention also provides a novel method for setting a transfer bias provided to a transfer device to develop an electrical field across a transfer gap.

In one exemplary embodiment, the method includes steps of voltage application, current sensing, and discharge detection. The application step applies a stepped-up, test voltage to the transfer device. The sensing step senses a current flowing to the transfer device during application of the test voltage. The detection step detects an electrical discharge occurring in the transfer gap based on an rate of increase of the sensed current.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1A:
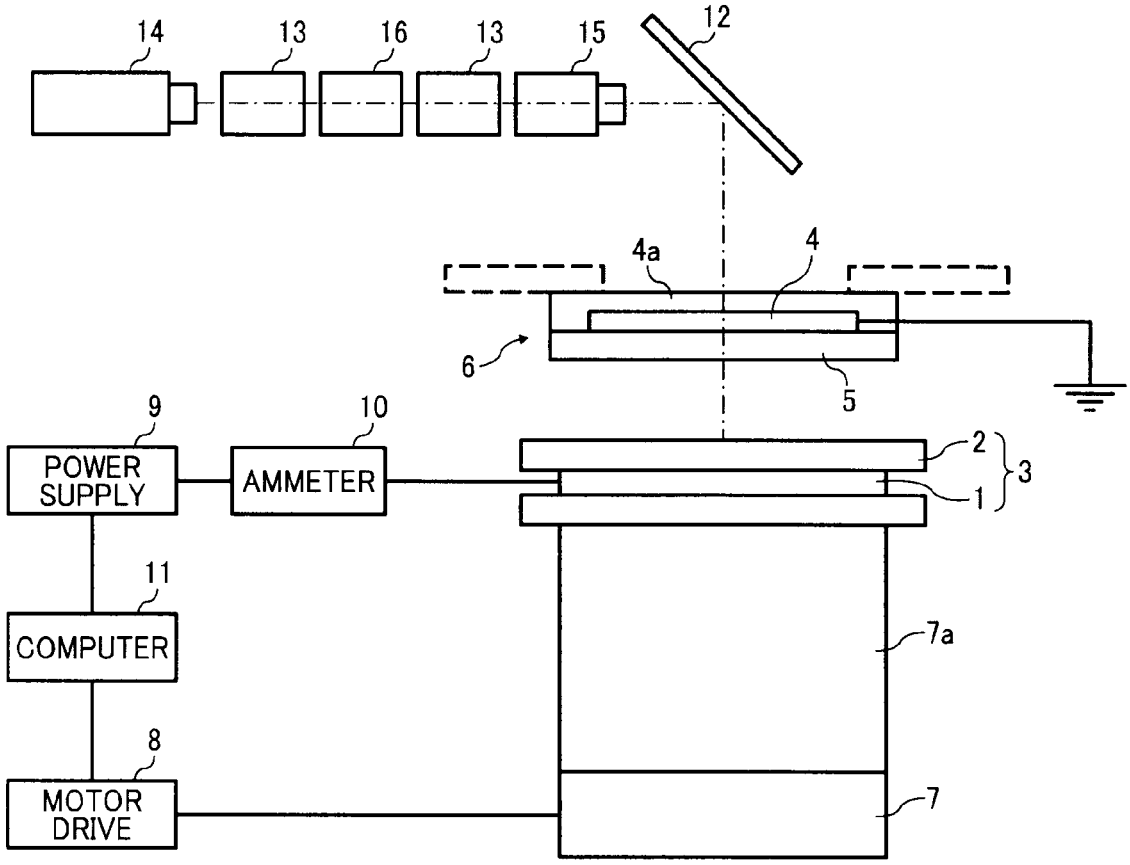
FIGS. 1A through 1C illustrate simulator equipment used in experiments for evaluating transfer performance with a variable transfer bias.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

This patent specification is directed to a transfer bias optimizer TBO that optimizes an electrical bias used to transfer images formed of toner particles from one medium to another in electrophotographic image formation. In order to facilitate an understanding of the purposes and principles of the bias control system according to this patent specification, a description is first given of experiments carried out to investigate current-voltage characteristics of an electrophotographic transfer device.

Figure 1B:
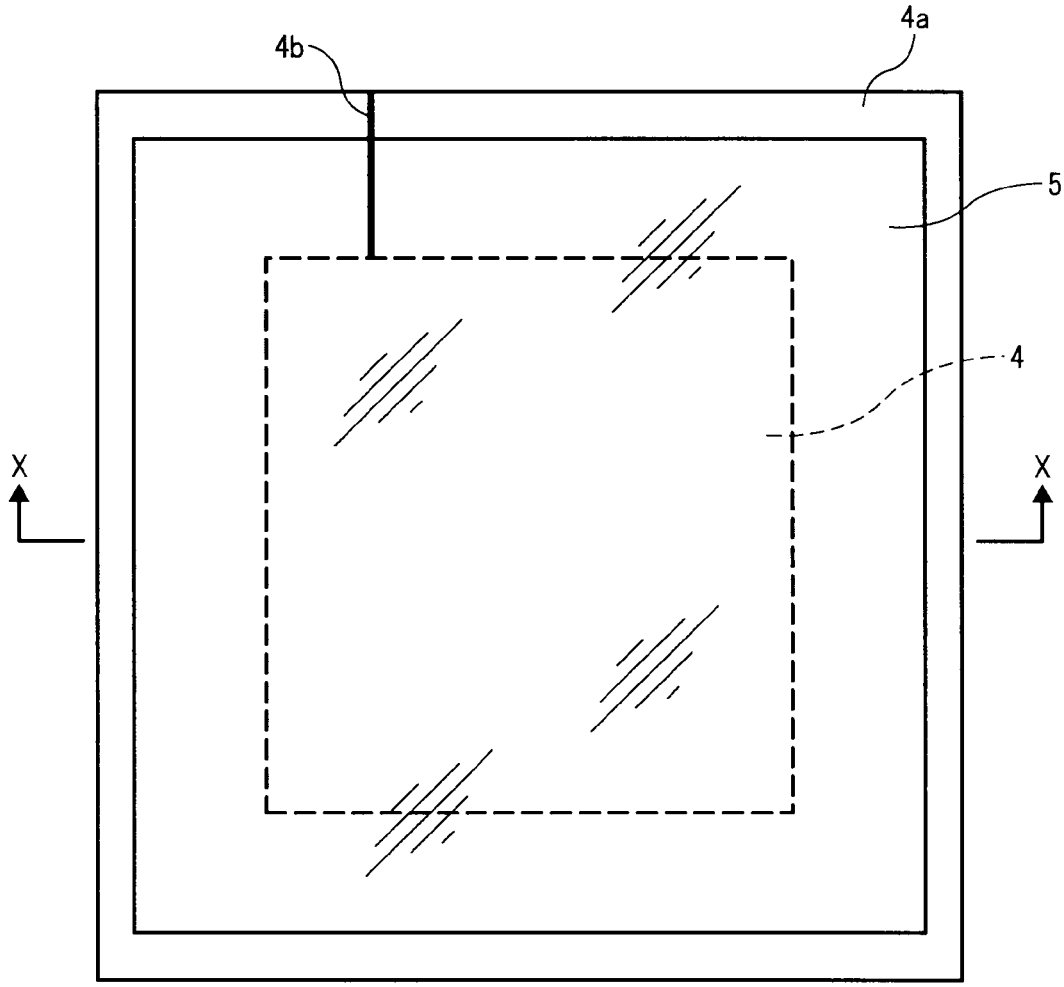
Figure 1C:
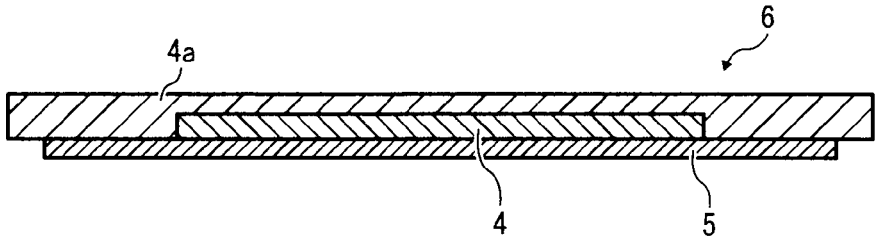

FIGS. 1A through 1C illustrate simulator equipment used in such experiments for evaluating transfer performance with a variable transfer bias.

As shown in FIG. 1A, the transfer simulator includes first and second substrates 3 and 6 disposed parallel to each other to define a gap therebetween. The lower, first substrate 3 is formed of a stainless steel (SS) electrode 1 having a polyimide (PI) sheet 2 bonded thereon with double-sided tape. The upper, second electrode 6 has a grounded, indium tin oxide (ITO) electrode 4 fitted in a glass support 4*a* and coated with a 55-μm thick polycarbonate (PC) layer 5. The PI-SS substrate 3 is mounted on a stage 7*a*, having a stepper motor 7 therebelow to raise and lower the stage 7*a* to adjust spacing (the gap) between the PI and PC surfaces in steps of 1 μm.

The transfer simulator also includes a motor drive 8 driving the stepper motor 7, a power supply 9 applying a voltage between the SS electrode 1 and the ITO electrode 4, an ammeter 10 inserted between the power supply 9 and the SS electrode 1, and a computer 11 controlling operation of the motor drive 8 and the power supply 9.

As shown in FIGS. 1B and 1C, the ITO electrode 4 defines a transparent region covered with the PC layer 5 and having a wire 4*b* connected to the power supply 9, on which a toner image of a given pattern may be formed through suitable development process. Instead of an ITO electrode with PC coating, a transparent plate of glass or plastic coated with a vapor-deposited, nanometer-thick layer of suitable material, such as carbon, gold, platinum, aluminum, silver, etc., may also be used as the substrate 6.

With continued reference to FIG. 1A, the equipment also includes an optical unit formed of a mirror 12, a couple of image intensifiers 13 (V1366P manufactured by Hamamatsu Photonics), a video camera 14, a first lens 15 (smc PENTAX-A DENTAL MACRO 1:4 100 mm, manufactured by PENTAX, HOYA Corporation), and a second lens 16 (smc PENTAX-FA 1:2.8 50 mm MACRO, manufactured by PENTAX, HOYA Corporation), disposed in series above the electrode substrates 3 and 6. The mirror 12 is disposed obliquely with respect to the parallel planes of the substrates 3 and 6, and to the optical axis of the video camera 14, respectively. The image intensifiers 13 are disposed between the mirror 12 and the video camera 14, one on the mirror side combined with the first lens 15, and the other on the video side combined with the second lens 16.

In such a configuration, the transfer simulator can simulate a transfer process in an image forming apparatus, wherein the SS electrode 1 serves as a biasing device to develop a transfer field in a transfer gap with the PI sheet 2 and the PC-ITO substrate 6 serving as an intermediate transfer belt and a photoconductor, respectively.

To transfer a toner image from the substrate 6 to the substrate 3, the power supply 9 applies a given bias voltage between the SS electrode 1 and the ITO electrode 4, while the motor drive 8 drives the stepper motor 7 to move the PI surface closer to and farther away from the PC surface.

During transfer, the ammeter 10 senses current flowing from the power supply 9 into the SS electrode 1, while the video camera 14 senses the gap between the PI and PC surfaces with the mirror 12 reflecting light from the transfer gap towards the image intensifiers 13 and the lenses 15 and 16 amplifying the reflected light. Having a theoretical luminance gain exceeding $3*10^9$, the optical unit can visualize faint light emission that occurs where the bias voltage applied to the SS electrode 1 causes an electrical discharge in the transfer gap.

Using the transfer simulator described above, the following experiments were carried out in a completely dark room conditioned to 25° C. and 50% relative humidity. In preparation for each simulation run, a solid image was developed on the PC surface of the ITO substrate 6 with magenta toner having a charge of −15 μC/g, resulting in toner particles distributed over the image area at a density of 1.8 mg/cm$^2$.

EXPERIMENT 1

The ITO substrate 6 bearing a developed toner image thereon was set in place, and the stepper motor 7 moved the SS-PI substrate 3 closer to the ITO substrate 6 while the power supply 9 applied a given constant voltage to the SS electrode 1 so as to transfer toner particles from the PC surface to the PI surface. After transfer, the lower substrate 3 was retracted away from the upper substrate 6, and the weight of toner particles present on the PI sheet 2 was measured.

The above procedure was repeated using different bias voltages ranging from 0 to 1700 V, for each of which a transfer rate of toner was calculated according to the following equation:

$$\text{Transfer rate}(\%)=Wa/Wb*100 \qquad \text{Equation 1}$$

where "Wa" is an amount of toner particles present on the PI surface after transfer, and "Wb" is an amount of toner particles forming an image developed on the PC-ITO substrate prior to transfer.

Figure 2:
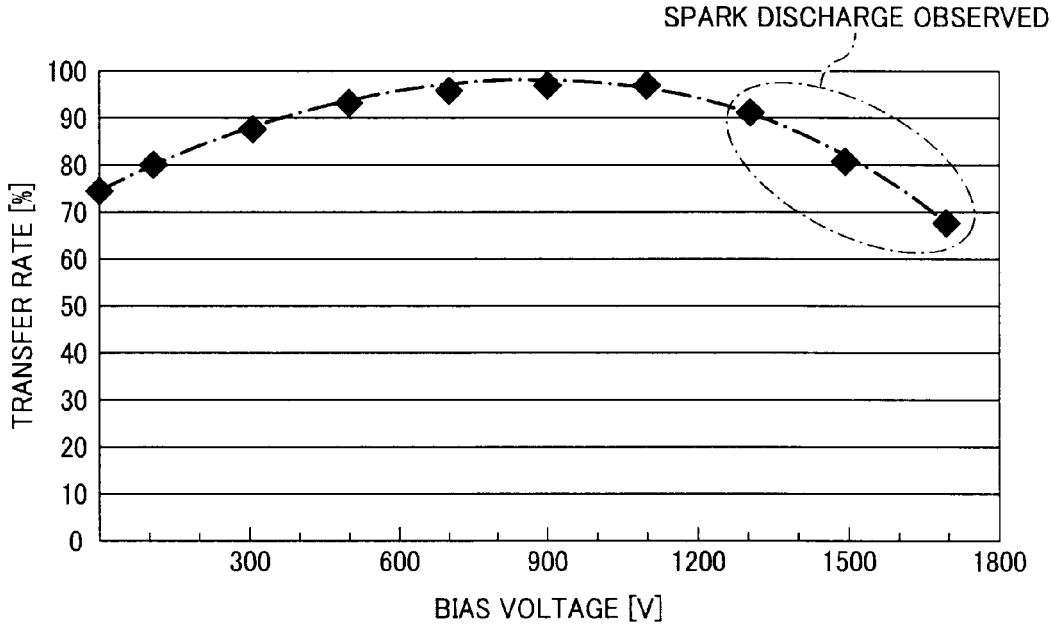
FIG. 2 shows experimental results plotting transfer rates against applied transfer bias voltages.

FIG. 2 shows results of Experiment 1, plotting calculated transfer rates against applied transfer bias voltages.

As shown in FIG. 2, the transfer rate increases as the bias voltage increases from 0 V, reaches a maximum at a bias voltage of approximately 1100 V, and begins to decrease when the bias voltage becomes as high as approximately 1300 to 1400 V. In addition, electrical discharges were observed as sparks of light in the transfer gap when bias voltages exceeding 1300 V were applied to the biasing electrode 1.

The fact that the decreased transfer rate and the spark discharge both concurred with the bias voltage exceeding 1300 V indicates that the electrical discharge caused by an excessive electric field might have affected the transfer of toner across the transfer gap. Hence, it can be concluded that an optimum bias voltage for obtaining a maximum transfer rate is slightly lower than a threshold voltage, which, if exceed, induces an electrical discharge in the transfer gap.

EXPERIMENT 2

The ITO substrate 6 bearing a developed toner image thereon was set in place, and the stepper motor 7 moved the SS-PI substrate 3 closer to the ITO substrate 6 while the power supply 9 applied a stepped-up voltage to the SS electrode 1 so as to transfer toner particles from the PC surface to the PI surface. During transfer, the ammeter 10 measured the current flowing into the SS electrode 1 with the bias voltage increased from 170 V to 1700 V in steps of 170 V per millisecond.

Figure 3:
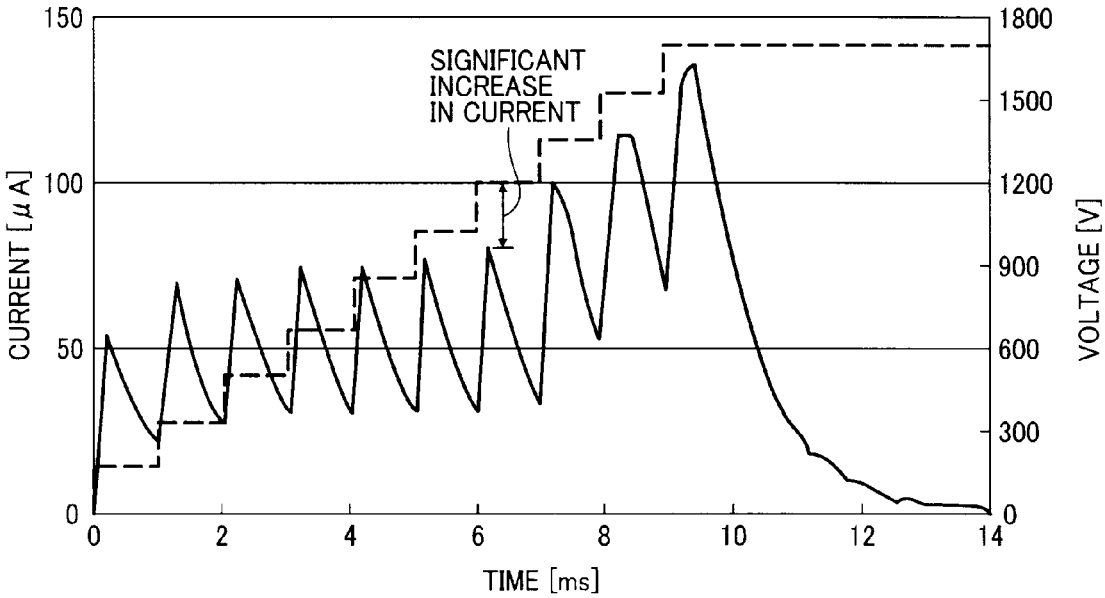
FIG. 3 shows experimental results plotting an output current with an applied bias voltage against time.

FIG. 3 shows measurement results of Experiment 2, plotting the output current in microamperes (solid line) with the applied bias voltage in volts (dotted line) against time in milliseconds.

As shown in FIG. 3, the current output to the electrode 1 traces a substantially regular, periodic waveform when the bias voltage is stepped up to 1190 V, except for the first millisecond in which the current level still remains low. The output current significantly increases as the applied voltage increases from 1190 V to 1360 V, followed by gradually rising current levels with the voltage stepped up from 1360 V to higher levels.

The current trace indicates that the output current with the bias voltage ranging from 340 V to 1190 V built up charge to establish an electric field across the transfer gap, and that electrical discharges occurred in the transfer gap with the bias voltage exceeding 1360 V, which is consistent with the results of Experiment 1. Thus, the current flowing with the stepped bias voltage definitely changes where the applied transfer field becomes excessive and causes an electrical discharge in the transfer gap.

It is to be noted that the significant increase in the output current with the applied voltages switched from 1190 V to 1360 V clearly indicates that the threshold voltage for inducing an electrical discharge in the transfer gap exists between 1190 V and 1360 V, providing a ready distinction between voltages inducing no electrical discharge and those inducing an electrical discharge. According to the conclusion of Experiment 1, in this case, 1190 V is an approximately optimum bias voltage for obtaining a maximum transfer rate with the transfer simulator.

To summarize the results of Experiments 1 and 2, it is possible to detect an electrical discharge occurring in a transfer gap when a current flowing with a stepped-up voltage applied across the transfer gap significantly increases upon stepping up of the applied voltage, and that a bias voltage one step lower than a voltage causing the electrical discharge is approximately optimum for obtaining a maximum transfer rate.

According to this patent specification, the transfer bias optimizer TBO applies a stepped-up test voltage to a biasing member while sensing the current flowing with the applied voltage, so as to detect a voltage at which an electrical discharge initially occurs in the transfer gap during test voltage application. By setting a bias voltage at a voltage one step lower than the detected voltage at which an electrical discharge initially occurs in the transfer gap, the transfer bias optimizer TBO obtains a nearly optimum transfer bias, that is, an effective transfer field that is neither too weak nor too strong to transfer toner particles at a high transfer rate across the transfer gap.

For proper working of the transfer bias optimizer TBO, it is necessary to increase the test voltage stepwise and not linearly. This is because the test voltage, if increased linearly, would reach higher levels before the output current builds up charge across the transfer gap, resulting in a current sensor failing to respond to a voltage at which an electrical discharge actually starts to occur, and detecting an incorrect, higher voltage as the threshold voltage. In addition, for efficiently sensing current with the stepped-up test voltage, it is desirable that the test voltage remain unchanged during an application time equal to or longer than a time constant of the current sensor.

Figure 4:
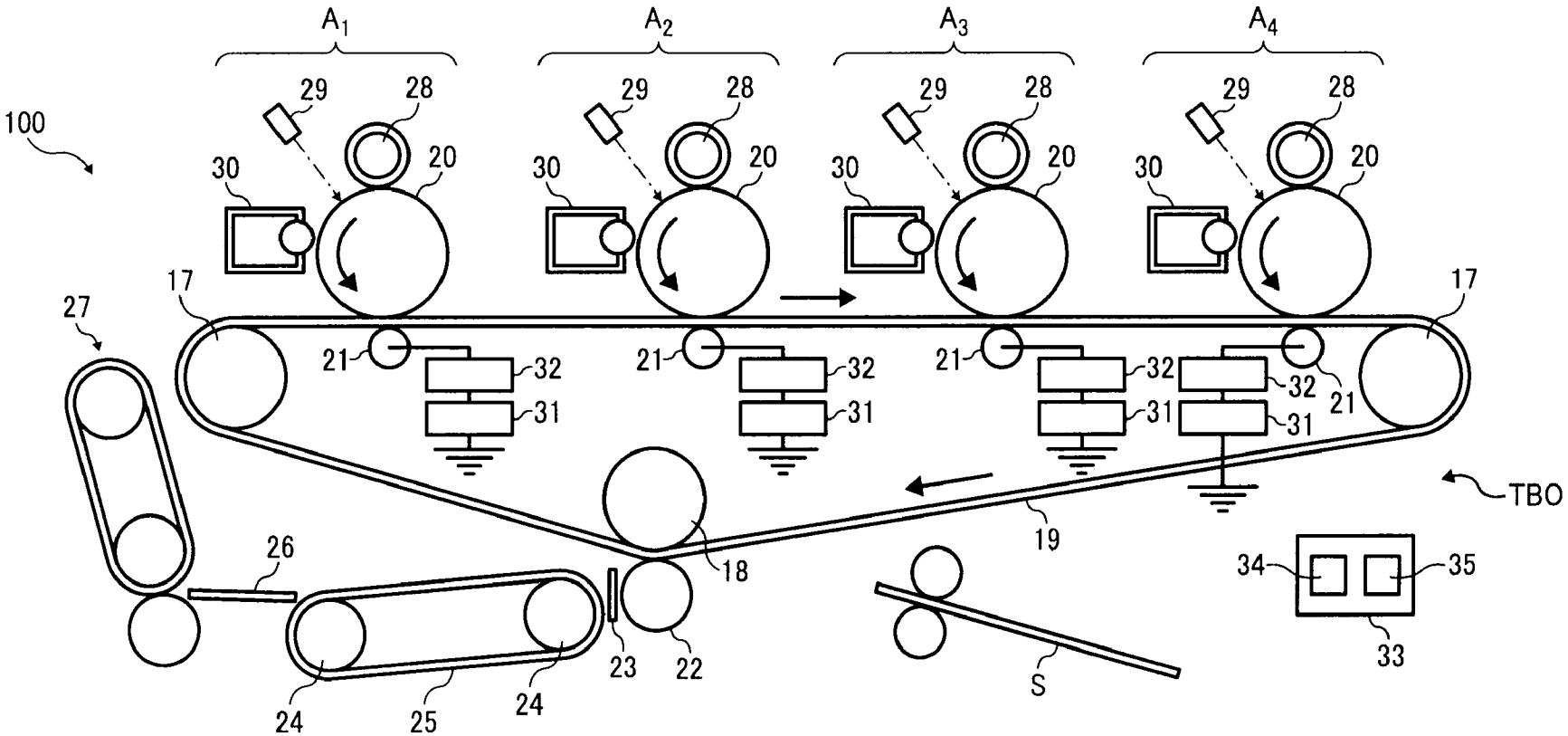
FIG. 4 schematically illustrates an image forming apparatus incorporating a transfer bias optimizer according to one embodiment of this patent specification.

Referring now to FIG. 4, an image forming apparatus 100 incorporating the transfer bias optimizer TBO according to one embodiment of this patent specification is described.

As shown in FIG. 4, the image forming apparatus 100 includes four imaging stations $A_1$ through $A_4$, each having a photoconductor drum 20 opposed to a primary transfer roller or bias roller 21, and surrounded by a non-contact charge roller 28, an exposure device 29, and a developing device 30 accommodating toner of a particular color used in electrophotographic color image reproduction: magenta, cyan, yellow, or black.

Below the imaging stations A is an intermediate transfer belt 19 trained around a pair of laterally spaced rollers 17 and a backup roller 18 located between and below the two rollers 17. The intermediate transfer belt 19 is passed through a primary transfer nip formed between each photoconductor drum 20 and its opposed roller 21, as well as a secondary transfer nip formed between the backup roller 18 and a secondary transfer roller 22.

The image forming apparatus 100 also includes equipment for handling recording sheets S, such as a discharge rod 23, a conveyor belt 25 trained around a pair of rollers 24, a sheet guide 26, and a fixing device 27 with a pressure roller and a heat roller forming a fixing nip through which is passed a fixing belt.

According to this patent specification, each primary transfer roller 21 is equipped with a voltage applicator 31 and a current sensor 32 forming part of the transfer bias optimizer TBO. The image forming apparatus 100 also includes a discharge detector 34 and a bias controller 35 provided on a control unit 33, also forming part of the transfer bias optimizer TBO.

The voltage applicator 31 is electrically connected to the primary transfer roller 21, and the current sensor 32 is inserted between the voltage applicator 31 and the primary transfer roller 21. The voltage applicator 31 and the current sensor 32 can exchange signals with the discharge detector 34 and the bias controller 35 residing in the control unit 33.

The following briefly describes a general operation of the image forming apparatus 100, the basic configuration of which is similar to that of an ordinary color printer using an intermediate transfer process, except for the transfer bias optimizer TBO according to this patent specification.

To print a multicolor image on a recording sheet S, the image forming apparatus 100 drives each imaging station A to form a visible image with toner of a particular color.

In each imaging station A, the photoconductor drum 20 rotates counterclockwise in the drawing so as to pass its outer photoconductive surface through a series of electrophotographic processes. First, the charge roller 28 uniformly charges the surface of the photoconductor drum 20 to a negative potential, followed by the exposure device 29 optically scanning the photoconductive surface to form an electrostatic latent image according to image data. Then, the developing device 30 develops the electrostatic latent image into a visible image with negatively charged toner particles.

Each toner image thus formed on the photoconductor drum 20 is advanced to the primary transfer nip, in which the voltage applicator 31 applies an electrical, transfer bias to the primary transfer roller 21 to develop a transfer field between the photoconductor drum 20 and the primary transfer roller 21. Such transfer bias may be a constant voltage of a positive polarity, i.e., the polarity opposite to that of the toner used. The transfer field transfers the negatively charged toner image onto the intermediate transfer belt 19.

Such primary transfer is sequentially performed in the respective imaging stations A in coordination with the intermediate transfer belt 19 passing through the primary transfer nips. As a result, the toner images of different colors are superimposed one atop another to form a multicolor, composite toner image on the intermediate transfer belt 19.

Then, the multicolor image is forwarded to the secondary transfer nip, in which a transfer field is developed between the roller 18 and the secondary transfer roller 22 by applying thereacross a bias voltage of a positive polarity, i.e., the polarity same as that of the toner used. The transfer field transfers the composite toner image to the recording sheet S fed by a sheet feeder.

After such secondary transfer, the sheet S bearing the toner image thereon is discharged by the discharge rod 23 provided with a direct current bias, and guided by the transport belt 25 and the guide plate 26, enters the fixing device 27. The fixing device 27 fixes the powder toner image in place with heat and pressure on the recording sheet S passing through the fixing nip. The sheet S after fixing is fed to an output unit, not shown, to complete one printing cycle.

Having described the general operation of the image forming apparatus 100, a detailed description is now given of the transfer bias optimizer TBO according to this patent specification.

As mentioned above, the image forming apparatus 100 transfers a toner image from the photoconductor drum 20 to the intermediate transfer belt 19 by providing the primary transfer roller 21 with an electrical, transfer bias to develop an electric field in the primary transfer nip. The transfer bias optimizer TBO according to this patent specification serves to optimize the transfer bias in the image forming apparatus 100. Although embodiments below mainly describe setting of a constant bias voltage Vbias, the transfer bias optimizer TBO can control either a bias voltage or a bias current.

To outline a general operation of the transfer bias optimizer TBO, the voltage applicator 31 applies a stepped-up, test voltage V to the primary transfer roller 21, while the current sensor 32 senses a current I flowing to the primary transfer roller 21 upon application of the test voltage V, and transmits the sensed values to the discharge detector 34. Then, the discharge detector 34 calculates a rate of increase of the sensed current I, and detects an electrical discharge occurring in the primary transfer nip when the current rate of increase exceeds a given threshold rate a of increase of current, which is determined, for example, empirically by experiments.

Such test voltage application, current sensing, and discharge detection are initiated and controlled by the bias controller 35. The bias controller 35 may direct the imaging station A to form a toner image of a given test pattern on the photoconductor drum 20 prior to initiating the bias voltage setting, so as to transfer the test image to the intermediate transfer belt 19 simultaneously with the test voltage application. Upon detection of an electrical discharge by the discharge detector 34, the bias controller 35 sets the transfer bias voltage Vbias to an optimum voltage inducing no electrical discharge in the primary transfer nip.

More specifically, the test voltage V applied by the voltage applicator 31 to the primary transfer roller 21 is stepped up every period of time Δt as expressed by the following equation:

$$V(k)=Vst+\Delta V*k \qquad \text{Equation 2}$$

where "Vst" represents an initial value for the test voltage V, "ΔV" represents adjustable increments or steps in which the test voltage V increases, and "k" is a variable, positive integer representing the number of times the test voltage V increments from the initial value Vst.

Preferably, the initial voltage Vst is approximately 600 volts (V) or so, which is reasonably high enough to save time required for discharge detection, and sufficiently low enough to ensure no discharge occurs upon initial voltage application. The increment ΔV may be in the range of approximately 150 V to approximately 200 V, and the application time Δt may be scaled in milliseconds (ms). Such parameters are preset and stored in memory for retrieval by the bias controller 35 initiating the bias voltage setting.

When the test voltage V is stepped up from V(k−1) to V(k), the current sensor 32 detects peak currents I(k−1) and I(k) for the respective voltages V(k−1) and V(k) and transmits the detected values to the discharge detector 34. Receiving the peak currents I(k−1) and I(k), the discharge detector 34 calculates the current rate of increase as a ratio of a difference between the consecutive peak currents I(k)−I(k−1) to the last peak current I(k), compares the calculated rate I(k)−I(k−1)/I(k) against the threshold rate α, and determines that the test voltage V(k) induces an electrical discharge in the primary transfer nip when the current rate of increase I(k)−I(k−1)/I(k) exceeds the threshold rate α.

Upon detection of an electrical discharge at the test voltage V(k), the bias controller 35 sets the bias voltage Vbias to V(k−1), an optimum voltage one step lower than the voltage V(k) initially inducing an electrical discharge in the primary transfer nip during test voltage application.

Consider a case in which the initial test voltage Vst is 600 V, the increment ΔV is 170 V, the application time Δt is 1 ms, and the threshold rate of increase α is 0.2.

Initially, the voltage applicator 31 applies the test voltage Vst or V(0) of 600 V to the primary transfer roller 21, while the current sensor 32 measures a first peak current I(0) for the applied voltage V(0) and transmits it to the discharge detector 34.

After the application time Δt of 1 ms has elapsed, the variable k is incremented from 0 to 1, and the voltage applicator 31 applies a second test voltage V(l) of 770 V to the primary transfer roller 21, while the current sensor 32 measures a second peak current I(1) for the applied voltage V(1) and transmits it to the discharge detector 34.

Upon receiving the consecutive peak currents I(0) and I(1), the discharge detector 34 calculates a current rate of increase (I(1)−I(0))/I(1) for the second step voltage V(1), compares it against the threshold rate α of 0.2, and detects an electrical discharge in the primary transfer nip when the threshold rate α is exceeded.

For example, when the first and second peak currents I(0) and I(1) are 78 μA and 100 μA, respectively, the current rate of increase for the second step voltage V(1) is (100−78)/100=0.22>0.2, indicating occurrence of an electrical discharge. On the other hand, when the first and second peak currents I(0) and I(1) are 88 μA and 100 μA, respectively, the current rate of increase is (100−88)/100=0.12<0.2, indicating absence of an electrical discharge.

The voltage application, current sensing, and discharge detection are repeated with the variable k incremented every 1 ms. When the current rate of increase (I(k)−I(k−1))/I(k) for the (k+1)th voltage V(k) exceeds the threshold rate α, the bias controller 35 sets the bias voltage Vbias to V(k−1) 170 V lower than the voltage V(k).

Such bias voltage setting takes place at suitable times during operation of the image forming apparatus 100, such as upon power-up, completion of a given number of printing cycles, replacement of imaging components, etc.

Figure 5:
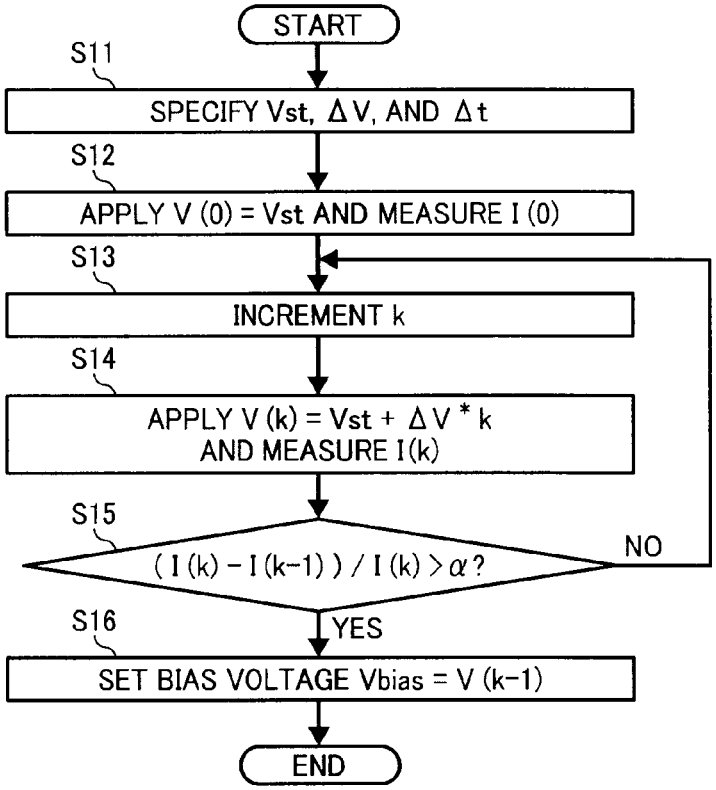
FIG. 5 is a flowchart illustrating an operation of the transfer bias optimizer incorporated in the image forming apparatus of FIG. 4.

FIG. 5 is a flowchart illustrating an operation of the transfer bias optimizer TBO incorporated in the image forming apparatus 100.

Upon activation, the bias controller 35 reads out the initial test voltage Vst, increment ΔV, application time Δt, and threshold rate α preset and stored in memory, such as Vst=600 V, ΔV=170 V, Δt=1 ms, and α=0.2. Simultaneously, each imaging station A forms a test pattern toner image on the photoconductor drum 20 (step S11).

Then, the voltage applicator 31 applies an initial test voltage V(0) or Vst to the primary transfer roller 21, while the current sensor 32 detects and stores a peak current I(0) for the test voltage V(0) (step S12).

When the application time Δt has elapsed, the variable k is incremented by one (step S13). Correspondingly, the voltage applicator 31 applies a subsequent test voltage V(k), while the current sensor 32 detects and stores a peak current I(k) for the applied test voltage V(k) (step S14).

Upon obtaining the consecutive peak currents I(k) and I(k−1), the discharge detector 34 calculates a current rate of increase (I(k)−I(k−1))/I(k) and compares it against the threshold rate α (step S15).

When (I(k)−I(k−1))/I(k)≦α ("NO" in step S15), the operation returns to step S13, determining that application of the test voltage V(k) causes no electrical discharge in the primary transfer nip.

When (I(k)−I(k−1))/I(k)>α ("YES" in step S15), the bias controller 35 determines that application of the test voltage V(k) causes an electrical discharge in the primary transfer nip, and sets the bias voltage Vbias to V(k−1), thereby completing one cycle of bias voltage setting (step S16).

Thus, the image forming apparatus 100 incorporating the transfer bias optimizer TBO according to this patent specification sets the bias voltage Vbias through test voltage application, current sensing, and discharge detection. This allows optimization of the transfer bias for specific applications, which reliably prevents incomplete transfer or reverse transfer caused by an insufficient or excessive transfer field, and maintains high transfer rate and good imaging quality irrespective of variations in environment and operational conditions.

Further, the image forming apparatus 100 may be configured to measure multiple current values at a given interval T shorter than the application time Δt of the voltage V(k), in which the current rate of increase for each applied voltage V(k) is determined by comparing a sum I_sum(k) of the measured currents against a corresponding threshold rate β.

Figure 6:
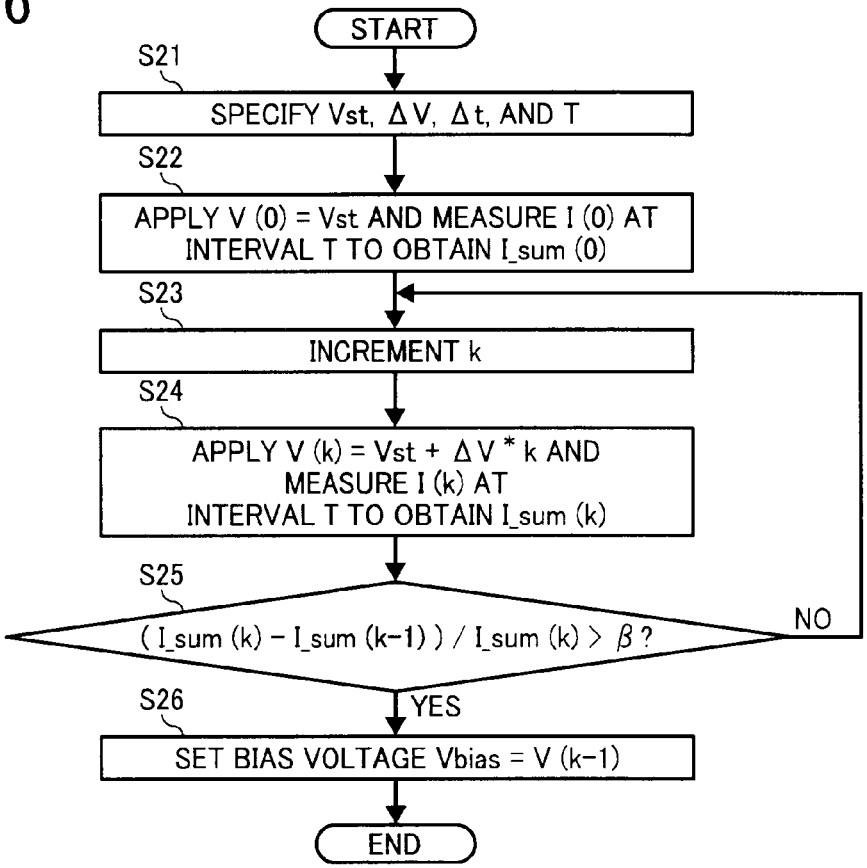
FIG. 6 is a flowchart illustrating another operation of the transfer bias optimizer incorporated in the image forming apparatus of FIG. 4.

FIG. 6 is a flowchart illustrating an operation of the transfer bias optimizer TBO incorporated in the image forming apparatus 100, which determines the current rate of increase based on the current sum I_sum(k).

Upon activation, the bias controller 35 reads out the initial test voltage Vst, increment ΔV, application time Δt, threshold rate β, and sampling interval T, preset and stored in memory, such as Vst=600 V, ΔV=170 V, Δt=1 ms, β=0.35, and T=200 μs. Simultaneously, each imaging station A forms a test pattern toner image on the photoconductor drum 20 (step S21).

Then, the voltage applicator 31 applies an initial test voltage V(0) or Vst to the primary transfer roller 21, while the current sensor 32 measures currents at the sampling interval T to calculate and store a sum I_sum(0) of the measured currents for the initial test voltage V(0) (step S22).

When the application time Δt has elapsed, the variable k is incremented by one (step S23). Correspondingly, the voltage applicator 31 applies a subsequent test voltage V(k), while the current sensor 32 calculates and stores a current sum I_sum (k) for the applied test voltage V(k) (step S24).

Upon obtaining the consecutive current sums I_sum(k) and I_sum(k−1), the discharge detector 34 calculates a current rate of increase (I_sum(k)−I_sum(k−1))/I_sum(k) and compares it against the threshold rate β (step S25).

When (I_sum(k)−I_sum(k−1))/I_sum(k)≦β ("NO" in step S25), the operation returns to step S23, determining that application of the test voltage V(k) causes no electrical discharge in the primary transfer nip.

When (I_sum(k)−I_sum(k−1))/I_sum(k)>β ("YES" in step S25), the bias controller 35 determines that application of the test voltage V(k) causes an electrical discharge in the primary transfer nip, and sets the bias voltage Vbias to V(k−1), thereby completing one cycle of bias voltage setting (step S26).

In such a configuration, the sum of multiple, sampled currents I_sum(k) allows more reliable determination of the current rate of increase than that allowed by the peak current I(k). Thus, using the bias voltage setting as depicted in FIG. 6, the image forming apparatus 100 can obtain a more effective transfer bias than that obtained with the configuration of FIG. 5.

Although the embodiments above describe the transfer bias optimizer TBO as being used to set a transfer bias for an intermediate transfer process, the bias voltage setting described in FIGS. 5 and 6 may also be used to set a transfer bias for a direct transfer process in which a toner image is transferred directly to a recording sheet from a photoconductor. In such cases, it is preferable to perform test voltage application in the presence of a recording sheet between the photoconductor and the transfer roller.

Additionally, it is also possible for a human operator or suitable external system, in place of the bias controller 35, to optimize the transfer bias using the voltage applicator 31, the current sensor 32, and the discharge detector 34 during manufacture or maintenance of the image forming apparatus. In addition, the test voltage application and current sensing described above may be performed without forming a test pattern toner image on the photoconductor drum.

In further embodiments, the transfer bias optimizer TBO according to this patent specification may set a transfer bias as a constant bias current instead of a constant bias voltage. In such cases, the bias current is set equal to a peak current or an average current that flows with a test voltage one step lower than a voltage initially inducing an electrical discharge in the transfer nip during test voltage application.

In still further embodiments, in addition to being capable of optimizing the transfer bias to prevent electrical discharges during transfer, the transfer bias optimizer TBO according to this patent specification can modify the transfer bias according to operating conditions of the image forming apparatus. Before describing specific embodiments in detail, a description is given of experiments carried out to clarify influence of the operating conditions on the transfer performance of an image forming apparatus.

EXPERIMENT 3

Printing was performed using plain A4 size copy paper (T6200 A4Y available from Ricoh Company Ltd.) and a direct transfer tandem color printer.

Initially, development was performed with suitable photoconductor charge and development bias so as to obtain a monochrome solid image with an area of 8 $cm^2$ and a toner density of 0.4 $mg/cm^2$ on the photoconductor drum. The toner image was then transferred to the copy paper by applying a given current bias. After transfer, the print engine was halted, and toner particles remaining on the surface of the photoconductor were collected by suction.

The above procedure was repeated with various transfer bias currents (5, 10, 20, 30, 40, 50, and 60 μA), for each of which a transfer rate was calculated according to the following equation:

$$\text{Transfer rate}(\%)=(Wc-Wd)/Wc*100 \qquad \text{Equation 3}$$

where "Wc" is the weight of toner present on the photoconductor prior to transfer, and "Wd" is the weight of toner remaining on the photoconductor after transfer.

In addition, solid and halftone images were printed with the different current biases to assess the quality of resulting images through visual inspection.

Figure 7:
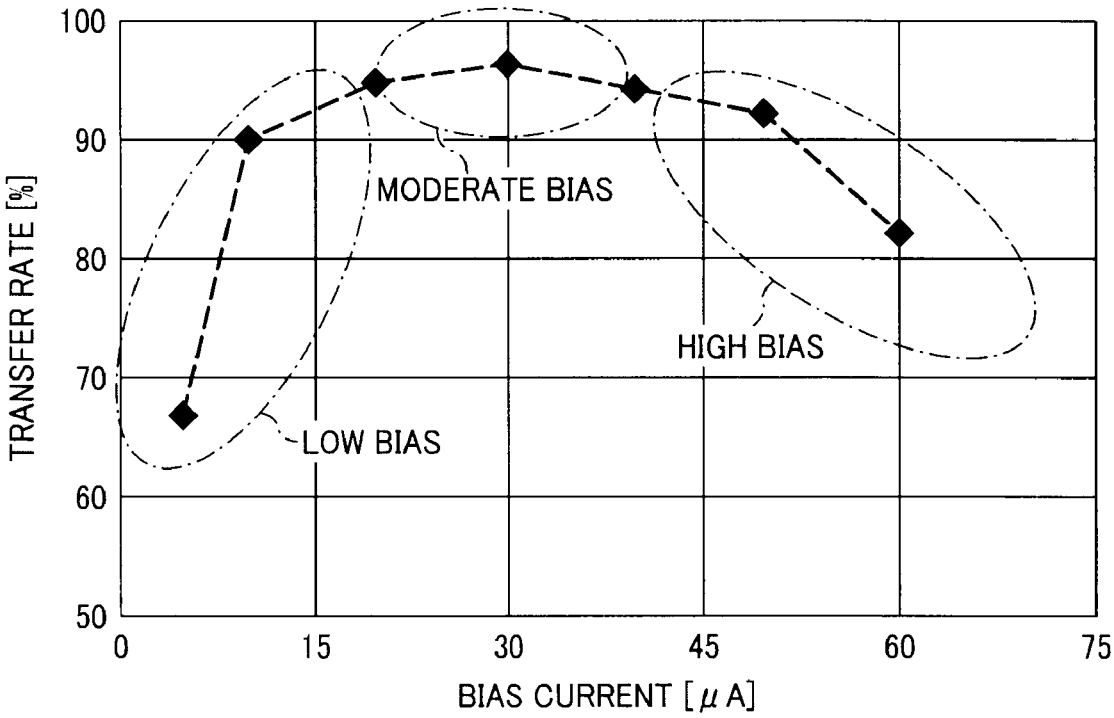
FIG. 7 shows experimental results plotting calculated transfer rates against applied transfer bias current.

FIG. 7 shows results of Experiment 3, plotting calculated transfer rates against applied transfer bias currents.

As shown in FIG. 7, the transfer rate increases with the bias current increased from 5 to 20 μA ("LOW BIAS"), reaches a maximum with the bias current ranging from 20 to 40 μA ("MODERATE BIAS"), and declines with the bias current exceeding 40 μA ("HIGH BIAS").

Such variation in the transfer rate is also confirmed through the visual inspection of printed images, in which the lower bias currents resulted in reduced density of solid images and fuzziness or graininess of halftone images, and the higher bias currents caused white spots and fuzziness on halftone images, whereas the moderate bias currents caused no reduced density in solid images or fuzziness in halftone images.

The results of Experiment 3 reveal that there is a limited range of optimum transfer bias currents at which the transfer device can transfer toner images at high transfer rates, and that applying a bias current higher or lower than this limited range results in a reduced transfer rate and concomitant image degradation.

EXPERIMENT 4

Printing was carried out using two types of developers D1 and D2, one unused and the other used. The unused developer D1 was completely fresh, just like newly installed in a brand-new printer, and the used developer D2 was acceleratedly aged through repetitive use in printing images of low image areas.

The procedure described in Experiment 3 was repeated with various transfer bias currents (5, 10, 20, 30, 40, and 50 μA), for each of which a transfer rate was calculated according to Equation 3.

In addition, solid and halftone images were printed with the different current biases to assess the quality of resulting images through visual inspection.

Figure 8:
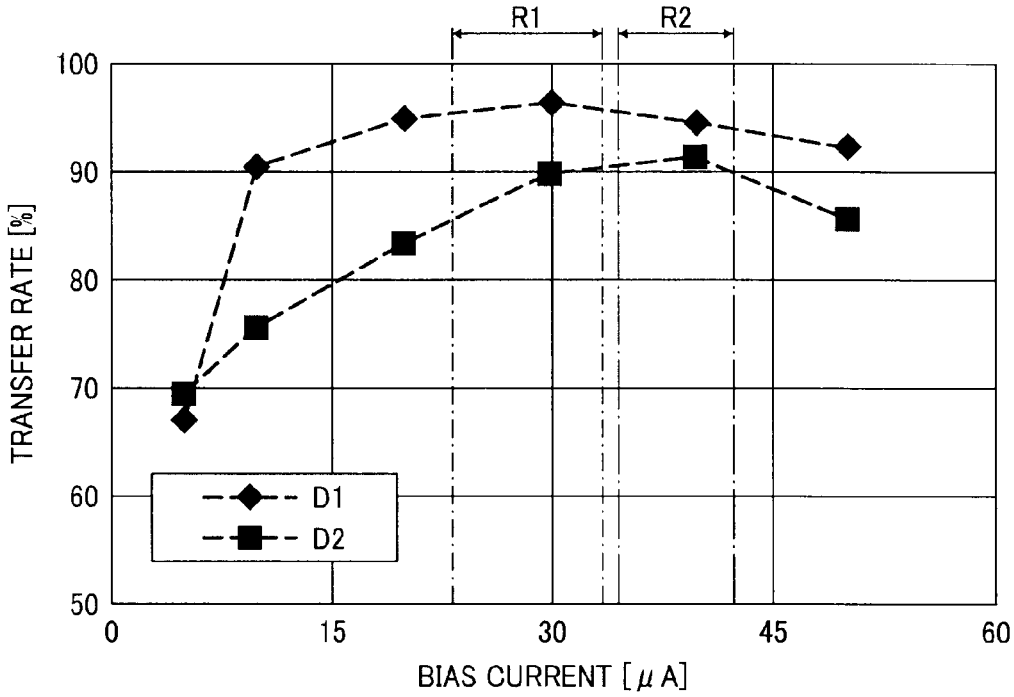
FIG. 8 shows experimental results plotting calculated transfer rates against applied transfer bias current for different types of developers.

FIG. 8 shows results of Experiment 4, plotting calculated transfer rates against applied transfer bias currents for the unused and used developers D1 and D2.

As shown in FIG. 8, the transfer rate curves for the developers D1 and D2 show a tendency similar to that described in FIG. 7, but have different current ranges R1 and R2 over which the developed images are transferred at maximum transfer rates. In both cases, image defects were observed where the applied bias current was beyond the limited current range.

The results of Experiment 4 indicate that the optimum range of bias current varies depending on the condition of developer in use. That is, bias currents desirable for the used developer are not necessarily desirable for the unused developer, and vice versa. For example, transferring an image developed with the used developer D2 by applying a bias current falling within the range R1 results in fuzzy images due to insufficient biasing. On the contrary, transferring an image developed with the unused developer D1 by applying a bias current falling within the range R2 results in image defects due to excessive biasing.

EXPERIMENT 5

Printing was carried out using two types of recording sheets S1 and S2 having different physical properties.

The procedure described in Experiment 3 was repeated with various transfer bias currents (5, 10, 20, 30, 40, and 50 μA), for each of which a transfer rate was calculated according to Equation 3.

In addition, solid and halftone images were printed with the different current biases to assess the quality of resulting images through visual inspection.

Figure 9:
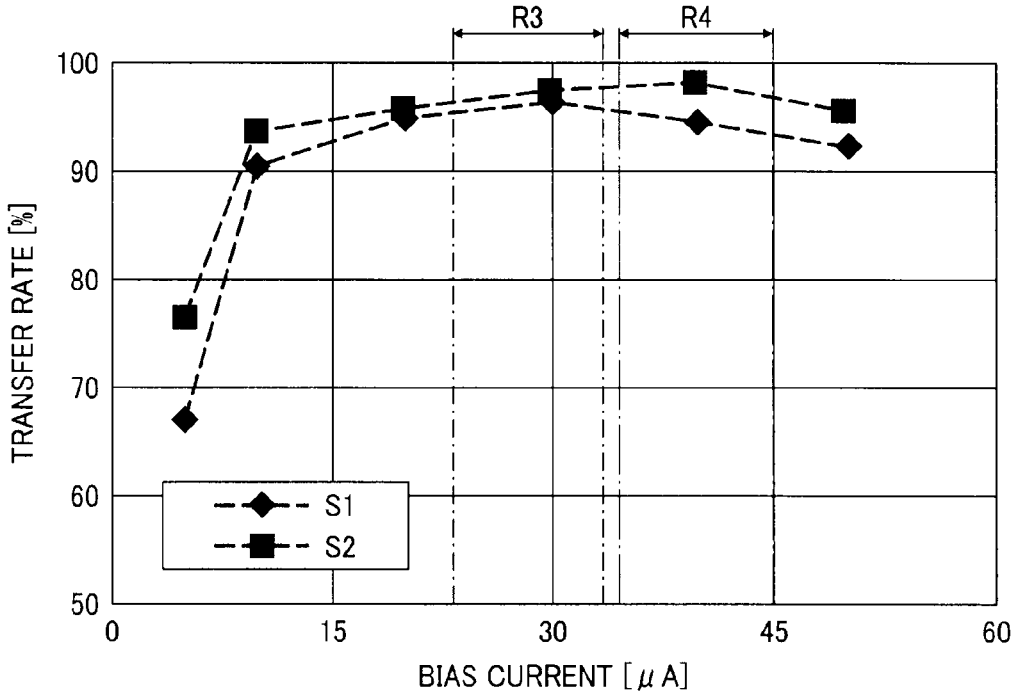
FIG. 9 shows experimental results plotting calculated transfer rates against applied transfer bias current for different types of recording sheets.

FIG. 9 shows results of Experiment 5, plotting calculated transfer rates against applied transfer bias currents for the different types of recording sheets S1 and S2.

As shown in FIG. 9, the transfer rate curves for the sheets S1 and S2 show a tendency similar to that described in FIG. 7, but have different current ranges R3 and R4 over which the images are transferred to the sheet surface at maximum transfer rates. In both cases, image defects were observed where the applied bias current was beyond the limited current range.

The results of Experiment 5 indicate that the optimum range of bias current varies depending on the type of recording sheet in use. That is, bias currents desirable for a particular type of recording sheet are not necessarily desirable for another type of copy sheet, and vice versa. For example, transferring an image to the recording sheet S2 by applying a bias current falling within the range R3 results in insufficient biasing. On the contrary, transferring an image to the recording sheet S1 by applying a bias current falling within the range R4 results in image defects due to excessive biasing.

To summarize, the experimental results indicate that high transfer rate and high imaging quality are obtained when a transfer bias used to transfer a toner image falls within a limited optimum range which depends on the condition of developer as well as on the type of recording sheet in use. Some research has revealed that the optimum range of transfer bias also depends on factors varying with time and/or environmental conditions, such as charge amounts of toner, resistance of a transfer member, etc. Consequently, it is desirable to modify the transfer bias with respect to various factors affecting the transfer process so as to prevent image degradation due to transfer failures, which would increase the effect of transfer bias optimization under specific applications.

Figure 10:
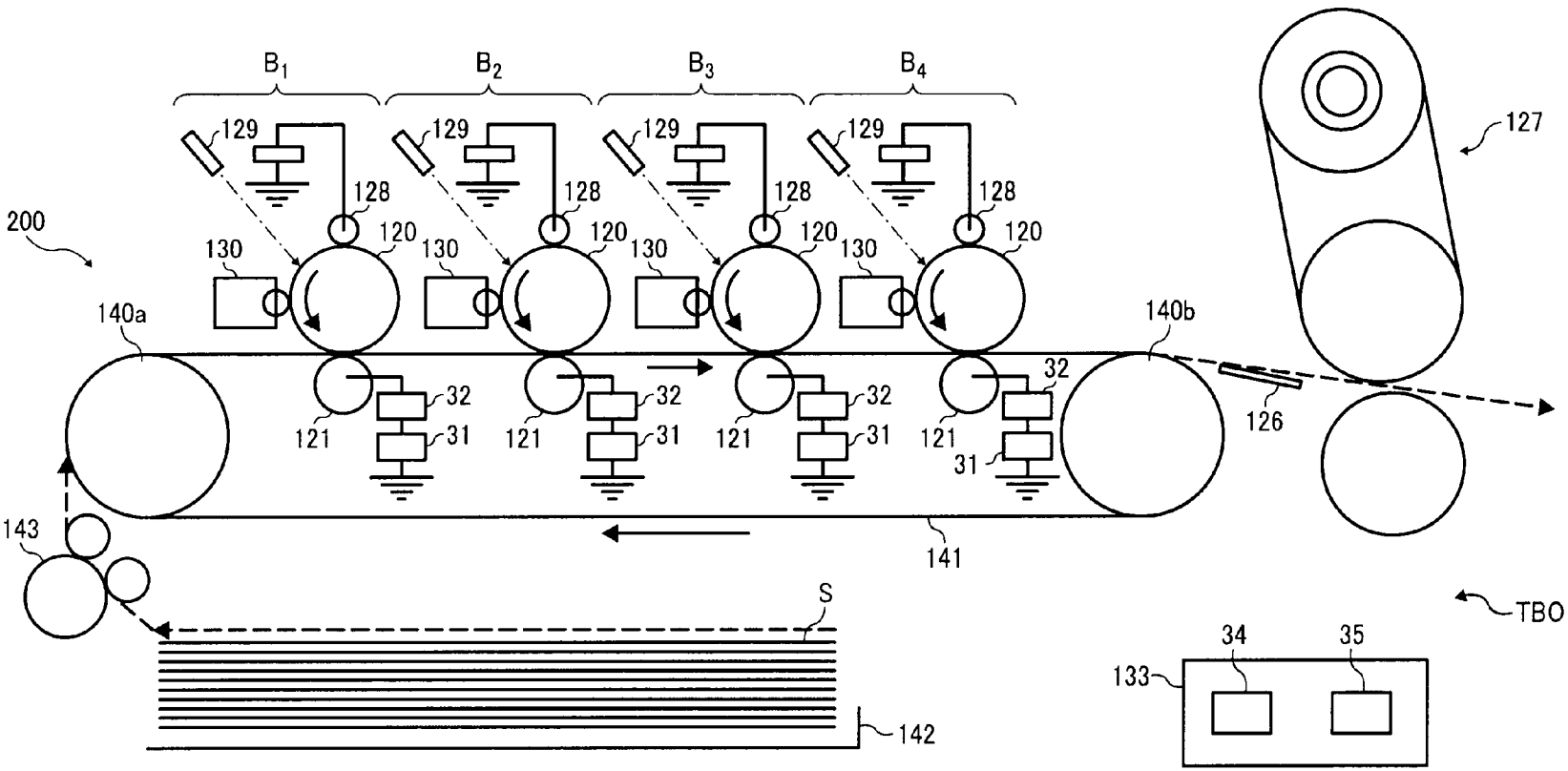
FIG. 10 schematically illustrates another image forming apparatus incorporating a transfer bias optimizer according to another embodiment of this patent specification.

Referring now to FIG. 10, a direct transfer, image forming apparatus 200 incorporating the transfer bias optimizer TBO according to another embodiment of this patent specification is described.

As shown in FIG. 10, the image forming apparatus 200 includes four imaging stations $B_1$ through $B_4$, each having a photoconductor drum 120 opposed to a transfer roller or bias roller 121, and surrounded by a non-contact charge roller 128, an exposure device 129, and a developing device 130 accommodating toner of a particular color used in electrophotographic color image reproduction: magenta, cyan, yellow, or black.

Below the imaging stations B is an endless, rotatable transport belt 141 trained around a pair of laterally spaced rollers 140*a* and 140*b*, and passed through a transfer nip formed between each photoconductor drum 120 and opposing roller 121.

The image forming apparatus 200 also includes equipment for handling recording sheets S, such as a sheet tray 142 accommodating a stack of recording sheets, a sheet feeder 143, a sheet guide 126, and a fixing device 127 with a pressure roller and a heat roller forming a fixing nip through which is passed a fixing belt.

In image forming apparatus 200, each transfer roller 121 is equipped with the voltage applicator 31 and the current sensor 32, electrically connected with the discharge detector 34 and the bias controller 35 implemented on a control unit 133, which together form the bias control system according to this patent specification.

The following briefly describes a general operation of the image forming apparatus 200, the basic configuration of which is similar to that of an ordinary color printer using a direct transfer process, except for the transfer bias optimizer TBO according to this patent specification.

To print a multicolor image on a recording sheet S, the image forming apparatus 200 drives each imaging station B to form a toner image of a particular primary color.

In each imaging station B, the photoconductor drum 120 rotates counterclockwise in the drawing so as to pass its outer photoconductive surface through a series of electrophotographic processes. First, the charge roller 128 uniformly charges the surface of the photoconductor drum 120 to a negative potential, followed by the exposure device 129 optically scanning the photoconductive surface to form an electrostatic latent image according to image data obtained, for example, by scanning an original document. Then, the developing device 130 develops the electrostatic latent image into a visible image with negatively charged toner particles. Each toner image thus formed on the photoconductor drum 120 is advanced to the transfer nip.

Meanwhile, the sheet feeder 143 picks up a recording sheet S from the sheet tray 142 and feeds it onto the transport belt 141. The transport belt 141 advances the fed sheet S toward the transfer nips. In each transfer nip, the voltage applicator 31 applies a transfer bias to the transfer roller 121 so as to develop a transfer field between the photoconductor drum 120 and the transfer roller 121. Such transfer bias may be a constant voltage of a positive polarity, i.e., the polarity opposite to that of the toner used. The transfer field transfers the negatively charged toner image to the recording sheet S on the transport belt 141.

Such transfer is sequentially performed in the respective imaging stations B in coordination with the recording sheet S passed through the transfer nips. As a result, the toner images of different colors are superimposed one atop another to form a multicolor, composite toner image on the recording sheet S.

Thereafter, the sheet S bearing the toner image thereon enters the fixing device 127, guided by the guide plate 126. The fixing device 127 fixes the powder toner image in place with heat and pressure on the recording sheet S passing through the fixing nip. The sheet S after fixing is fed to an output unit, not shown, to complete one printing cycle.

In the image forming apparatus 200, the transfer bias optimizer TBO according to this patent specification sets the transfer bias voltage Vbias applied to the transfer roller 121 in a manner similar to those depicted in FIGS. 5 and 6, except that the transfer bias voltage Vbias is modified according to the type of recording sheet onto which the toner image is directly transferred from the photoconductor drum 120 in the transfer nip.

Specifically, in modifying the transfer bias voltage Vbias, the bias controller 35 is activated to initiate the test voltage application, current sensing, and discharge detection in response to a user specifying a type of recording sheet used for printing. Upon detection of an electrical discharge in the transfer nip, the bias controller 35 records an optimum voltage Vopt or V(k−1) one step lower than a voltage V(k) initially inducing an electrical discharge in the transfer nip during test voltage application, as well as a current Iopt or I(k−1) flowing into the transfer roller 121 at the optimum voltage Vopt. With the voltage Vopt and the current Iopt thus obtained, the bias controller 35 calculates the modified transfer bias voltage Vbias according to the following equation:

$$Vbias = Vopt + Cm * Iopt \qquad \text{Equation 4}$$

wherein "Cm" is a given correction value depending on the type of recording sheet specified for printing.

In Equation 4, the term Cm*Iopt, being a product of the correction value Cm and the current Iopt, represents a corrective voltage added to the optimum voltage Vopt to obtain the modified bias voltage Vbias. The correction value Cm, which gives the corrective voltage when multiplied by the current Iopt, may represent resistance of a recording sheet obtained from current-voltage characteristics of the transfer roller 121, which is measured in the presence of the recording sheet passing through the transfer nip when printing is not performed. Different correction values for different types of recording sheets may be calculated in advance and stored in memory for retrieval by the bias controller 35 initiating bias voltage setting.

The embodiment above makes use of the fact that the optimum transfer bias for the direct transfer process, be it a voltage or a current, depends on the type of recording sheet in use, as is confirmed by Experiment 5 (see FIG. 9). That is, the voltage V(k−1) one step lower than the voltage V(k) initially inducing an electrical discharge during test voltage application, which is defined as the optimum transfer bias for intermediate transfer process, can be inadequate when used for direct transfer process in which a toner image is directly transferred to a recording sheet intervening in the transfer gap, having a specific physical property. In the image forming apparatus 200, the corrective voltage obtained from the sheet-dependent correction value Cm corrects the bias voltage Vbias for such possible inadequacy in the direct transfer process.

Figure 11:
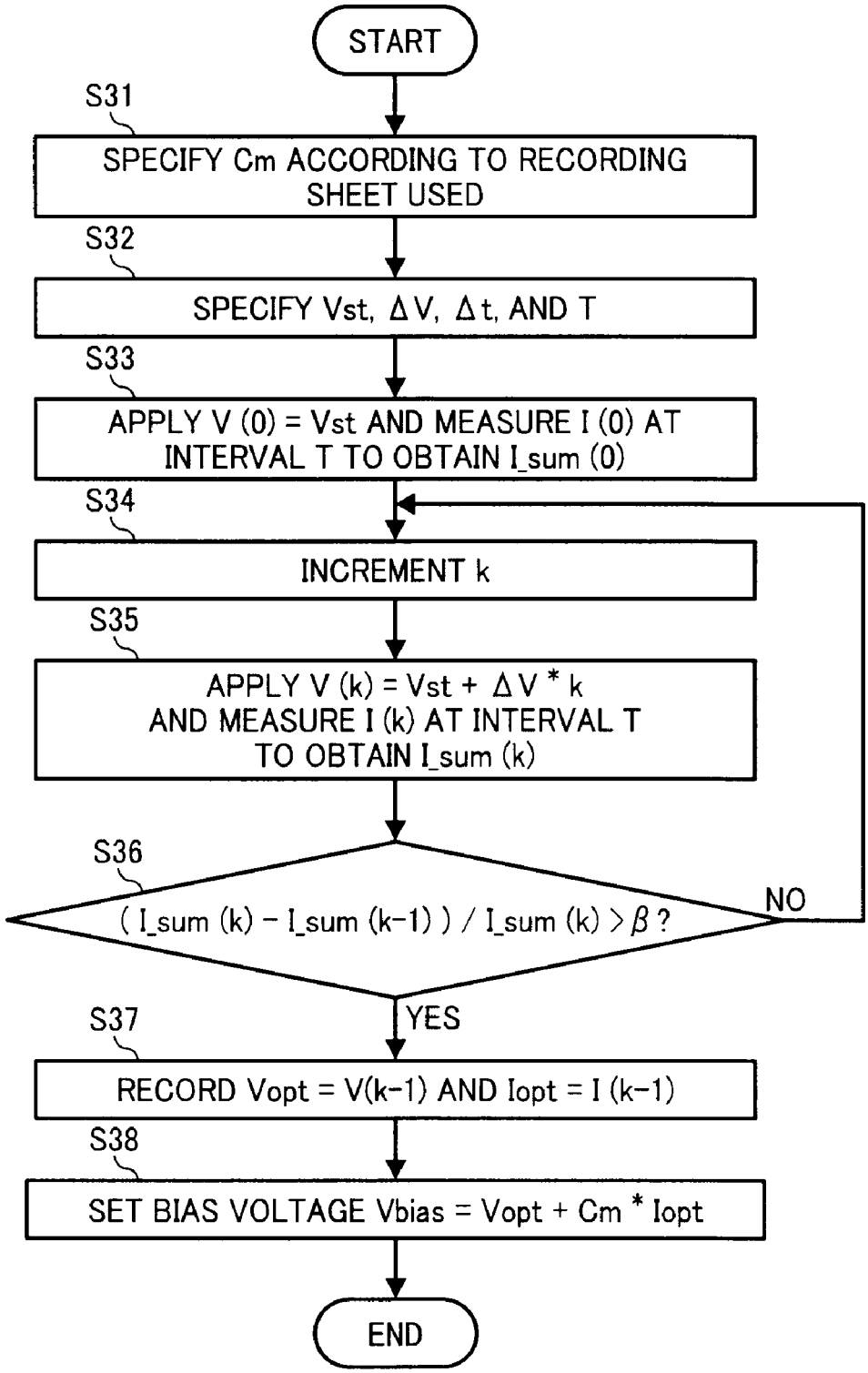
FIG. 11 is a flowchart illustrating an operation of the transfer bias optimizer incorporated in the image forming apparatus of FIG. 10.

FIG. 11 is a flowchart illustrating an operation of the transfer bias optimizer TBO incorporated in the image forming apparatus 200.

First, the bias controller 35 reads out the correction value Cm from memory according to the type of recording sheet specified by a user on a suitable user interface or control panel (step S31).

Then, the bias controller 35 reads out the initial test voltage Vst, increment ΔV, application time Δt, threshold rate β, and sampling interval T, preset and stored in memory, such as Vst=600 V, ΔV=170 V, Δt=1 ms, P=0.35, and T=200 μs. Simultaneously, each imaging station B forms a test pattern toner image on the photoconductor drum 120 (step S32).

Then, the voltage applicator 31 applies an initial test voltage V(0) or Vst to the transfer roller 121, while the current sensor 32 measures currents at the sampling interval T to calculate and store a sum I_sum(0) of the measured currents for the initial test voltage V(0) (step S33).

When the application time Δt has elapsed, the variable k is incremented by one (step S34). Correspondingly, the voltage applicator 31 applies a subsequent test voltage V(k), while the current sensor 32 calculates and stores a current sum I_sum (k) for the applied test voltage V(k) (step S35).

Upon obtaining the consecutive current sums I_sum(k) and I_sum(k−1), the discharge detector 34 calculates a current rate of increase (I_sum(k)−I_sum(k−1))/I_sum(k) and compares it against the threshold rate β (step S36).

When (I_sum(k)−I_sum(k−1))/I_sum(k)≦β ("NO" in step S36), the operation returns to step S34, determining that application of the test voltage V(k) causes no electrical discharge in the transfer nip.

When (I_sum(k)−I_sum(k−1))/I_sum(k)>β ("YES" in step S36), the bias controller 35 determines that application of the test voltage V(k) causes an electrical discharge in the transfer nip, and records a voltage Vopt or V(k−1) one step lower than the applied voltage V(k) as well as a peak current Iopt or I(k−1) for the voltage Vopt (step S37).

Then, the bias controller 35 calculates a corrective voltage Cm*Iopt, adds it to the voltage Vopt, and completes the operation by setting the modified bias voltage Vbias at the obtained sum Vopt+Cm*Iopt (step S38).

Figure 12:
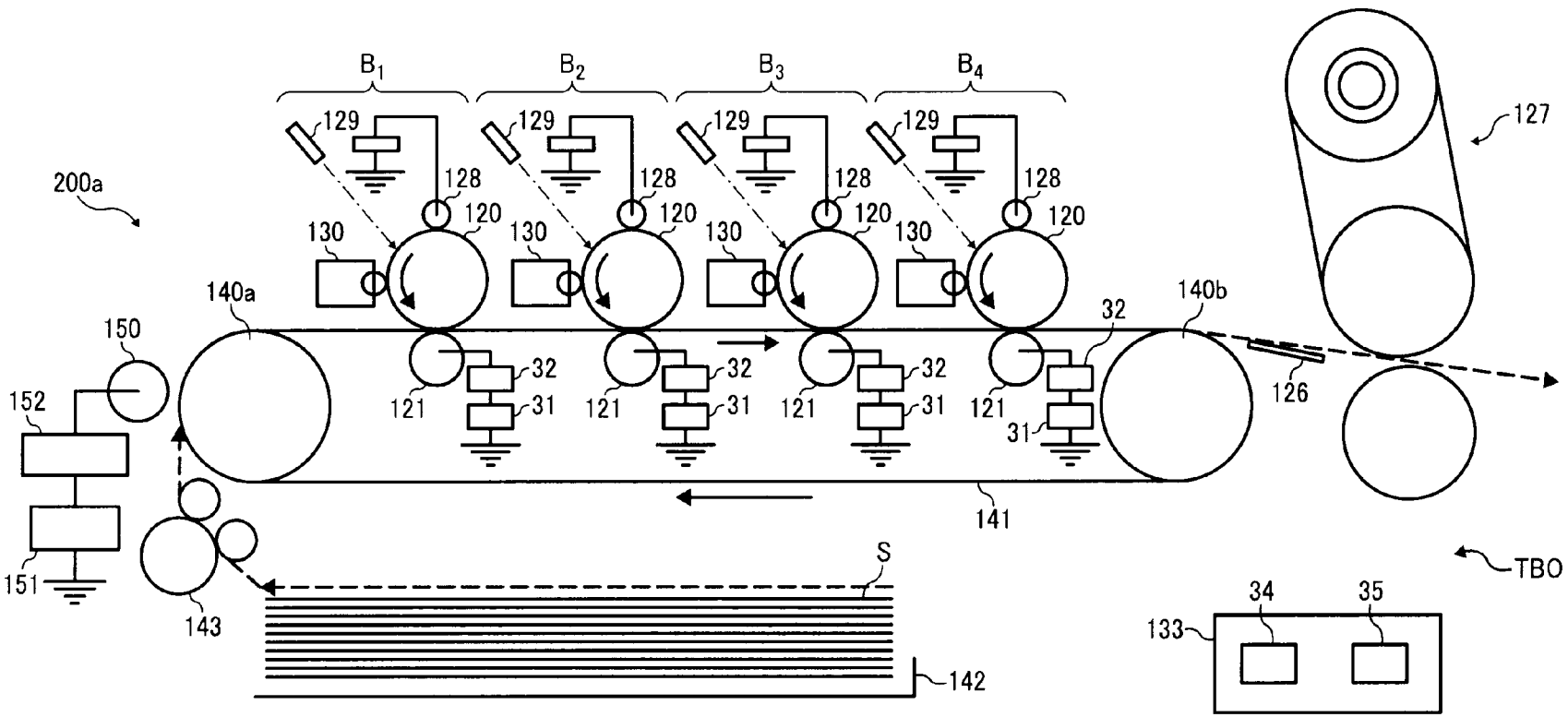
FIG. 12 schematically illustrates an image forming apparatus incorporating a transfer bias optimizer according to still another embodiment of this patent specification.

Referring now to FIG. 12, an image forming apparatus 200*a* incorporating the transfer bias optimizer TBO according to still another embodiment of this patent specification is described.

As shown in FIG. 12, the image forming apparatus 200*a* is configured in a manner similar to that depicted in FIG. 10, except that the transfer bias optimizer TBO additionally includes a biasing roller 150, a constant voltage applicator 151, and a current detector 152, and that the roller 140*a* supporting the transport belt 141 adjacent to the sheet feeder 143 is electrically grounded.

In the image forming apparatus 200*a*, the biasing roller 150 faces the grounded roller 140*a* at a point upstream from the transfer nip formed between the transfer roller 121 and the photoconductor drum 120 in the proximal imaging station $B_1$. The constant voltage applicator 151 is electrically connected to the biasing roller 150 via the current detector 152, and the voltage applicator 151 and the current detector 152 both can communicate with the bias controller 35.

In such a configuration, the image forming apparatus 200*a* sets the transfer bias voltage Vbias in a manner similar to that depicted in FIG. 11, except that the sheet-dependent correction value Cm is dynamically determined for a particular recording sheet S based on a current flowing into the biasing roller 150 at a given constant voltage in the presence of the recording sheet S between the biasing roller 150 and the roller 140*a*.

Specifically, to dynamically determine the correction value Cm, the sheet feeder 143 feeds a recording sheet S onto the transport belt 141 for transport to a measuring point between the biasing roller 150 and the adjoining roller 140*a*. As the sheet S passes through the measuring point, the constant voltage applicator 151 applies a given constant voltage Vm to the biasing roller 150, while the current detector detects a current Im flowing into the biasing roller 150 upon application of the given constant voltage Vm. Obtaining the current Im, the bias controller 35 calculates the correction value or resistance Cm as a ratio Vm/Im of the given constant voltage Vm to the detected current Im.

Then, the bias control system determines a voltage Vopt or V(k−1) one step lower than a voltage V(k) inducing an electrical discharge in the transfer nip as well as a current Iopt or I(k−1) flowing into the transfer roller 121 at the one-step-lower voltage Vopt in the manner described above. With the correction value Vm/Im, the voltage Vopt, and the current Iopt thus obtained, the bias controller 35 calculates a corrective voltage Vm/Im*Iopt, and sets the modified transfer bias voltage Vbias according to the following equation:

$$Vbias = Vopt + Vm/Im * Iopt \qquad \text{Equation 5}$$

In Equation 5, the term Vm/Im, representing the sheet-dependent correction value Cm, gives the slope of voltage-current curve, or resistance of a particular recording sheet passed through the measuring point on the transport belt 141 upstream of the imaging stations B.

It is known that the optimum transfer bias can be affected not only by the type of recording sheet in use, such as thickness, smoothness, coating, material, etc., but also by the actual condition of an individual recording sheet, such as moisture, lot quality, etc. Thus, the dynamically determined resistance Vm/Im effectively corrects the transfer bias since it reflects the actual condition of a particular recording sheet immediately before printing, in contrast to a resistance statically measured by a resistance meter outside an image forming apparatus, or a resistance empirically determined in advance for a type of recording sheet inside an image forming apparatus.

Figure 13:
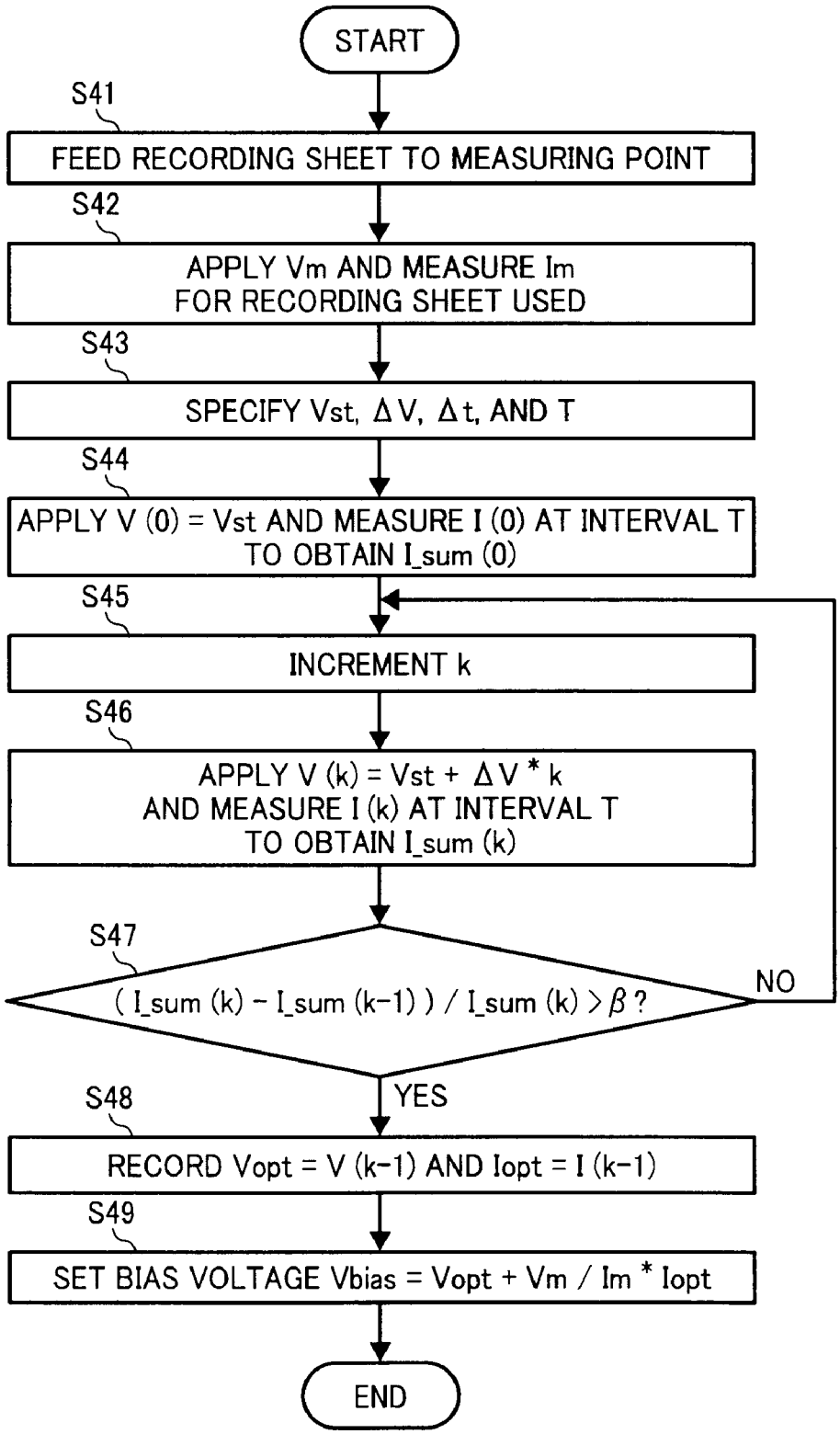
FIG. 13 is a flowchart illustrating an operation of the transfer bias optimizer incorporated in the image forming apparatus of FIG. 12.

FIG. 13 is a flowchart illustrating operation of the transfer bias optimizer TBO incorporated in the image forming apparatus 200*a*.

First, in response to a user specifying the type of recording sheet on a suitable user interface or control panel, each imaging station B forms a test pattern toner image on the photoconductor drum 20, while the sheet feeder 143 feeds a recording sheet S to the transport belt 141 for transport to the imaging station B (step S41).

As the sheet S reaches the measuring point upstream of the imaging station B, the constant voltage applicator 151 applies a given constant voltage Vm to the biasing roller 150, so that the current detector 152 detects a current Im flowing into the biasing roller 150 at the voltage Vm. The applied voltage Vm and the detected current Im are stored in memory for later retrieval (step S42).

Subsequently, the operation performs test voltage application, current sensing, and discharge detection in the manner described in steps S32 through S36 of FIG. 7 (steps S43 through S47).

When determining that application of a test voltage V(k) causes an electrical discharge in the transfer nip, the bias controller 35 records a voltage Vopt or V(k−1) one step lower than the voltage V(k) as well as a peak current Iopt or I(k−1) measured for the voltage V(k−1) (step S48).

Then, the bias controller 35 calculates a resistance Vm/Im to obtain a corrective voltage Vm/Im*Iopt, adds it to the voltage Vopt, and completes the operation by setting the modified bias voltage Vbias at the obtained sum Vopt+Vm/Im*Iopt (step S49).

Further, the transfer bias optimizer TBO described above can perform more effective correction on the transfer bias by using several parameters actually measured during bias voltage setting in addition to the current-voltage characteristic measured for a recording sheet in use.

Specifically, the bias control system determines a voltage Vopt or V(k−1) and a current Iopt or I(k−1) in the manner described above. In addition, the bias control system records a voltage Vt or V(k) initially inducing an electrical discharge in the transfer nip during voltage application as well as a current It or I(k) flowing with the voltage V(k). With the parameters Vm, Im, Vopt, Vt, and It thus obtained, the bias controller 35 sets the modified transfer bias voltage Vbias according to the following equation:

$$Vbias=Vopt*(VtIm+VmIt)/(Vt*Im) \quad \text{Equation 6}$$

As can be seen from Equation 6, the use of the various parameters allows for more comprehensive determination of the bias voltage, and thus, more effective optimization of the transfer bias.

Figure 14:
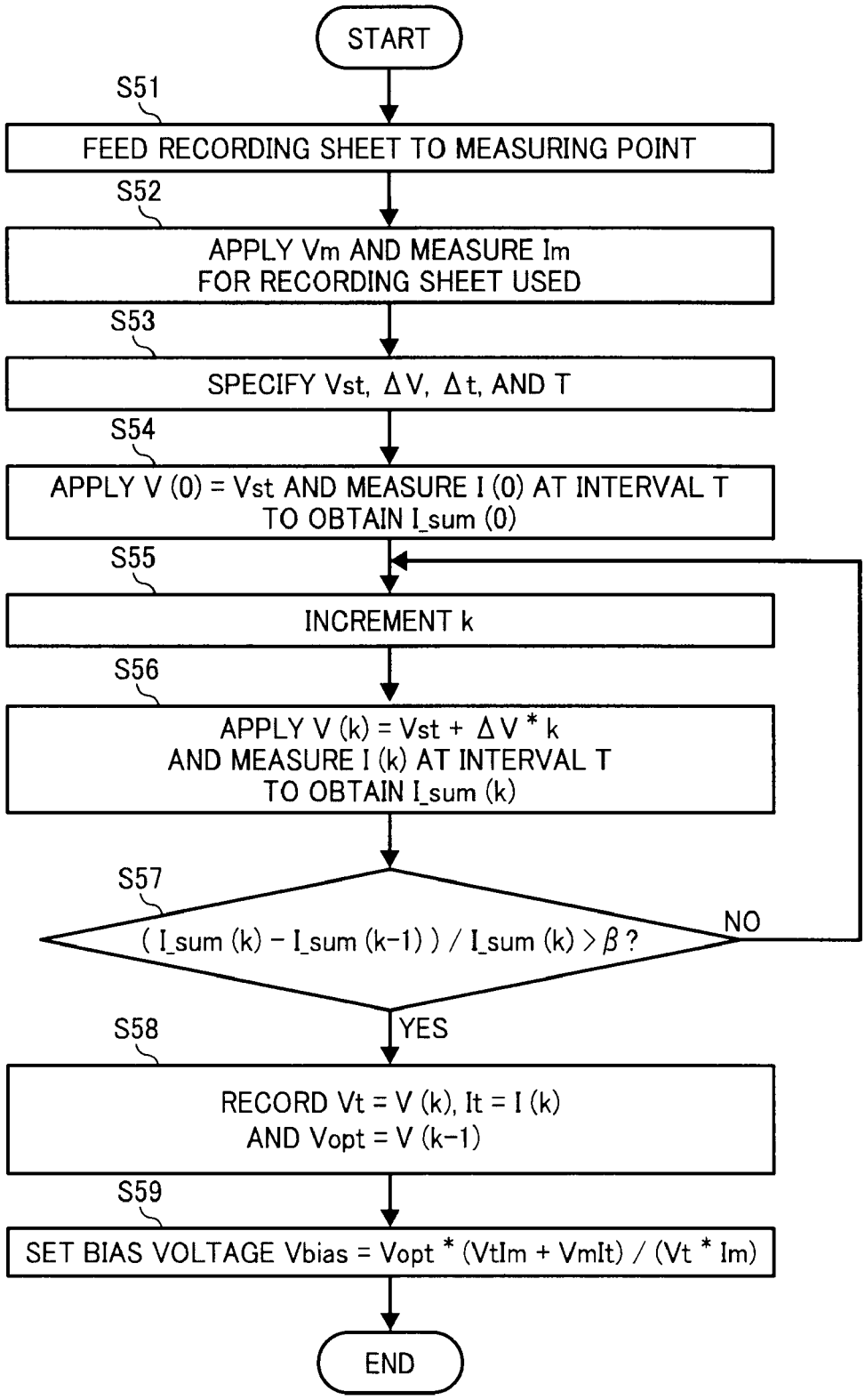
FIG. 14 is a flowchart illustrating another operation of the transfer bias optimizer incorporated in the image forming apparatus of FIG. 12.

FIG. 14 is a flowchart illustrating another operation of the transfer bias optimizer TBO incorporated in the image forming apparatus 200*a*.

When activated by a user specifying the type of recording sheet, the alternative bias setting obtains parameters Vm and Im for a recording sheet S in use, and performs test voltage application, current sensing, and discharge detection in the manner described in steps S41 through S47 of FIG. 13 (steps S51 through S57).

Upon detection of an electrical discharge in the transfer nip, the bias controller 35 records a voltage Vt or V(k) inducing the electrical discharge, a voltage Vopt or V(k−1) one step lower than the voltage V(k), and a current It or I(k) measured for the voltages V(k) (step S58).

Then, the bias controller 35 the bias controller 35 performs calculation using the various parameters and completes the operation by setting the modified transfer bias voltage Vbias to a calculated value Vopt*(VtIm+VmIt)/(Vt*Im) (step S59).

Preferably, the image forming apparatus 200*a* has a user interface, such as an operating panel, showing a waiting message during transfer bias setting, particularly when the bias control system performs the test voltage application, current sensing, and discharge detection following dynamic resistance measurement for each recoding sheet in use.

It can be appreciated that the image forming apparatus 200*a* may perform the test voltage application, current sensing, and discharge detection simultaneously with dynamic resistance measurement for a particular recoding sheet in response to a user specifying print settings. This allows the image forming apparatus to determine the modified transfer bias voltage during preparation of image data for printing, leading to a reduction of wait time required to complete printing after optimizing the bias voltage.

In still further embodiments, the transfer bias optimizer TBO according to this patent specification can adjust the period of time Δt for test voltage application depending on the current sensing capability of the image forming apparatus.

Figure 15:
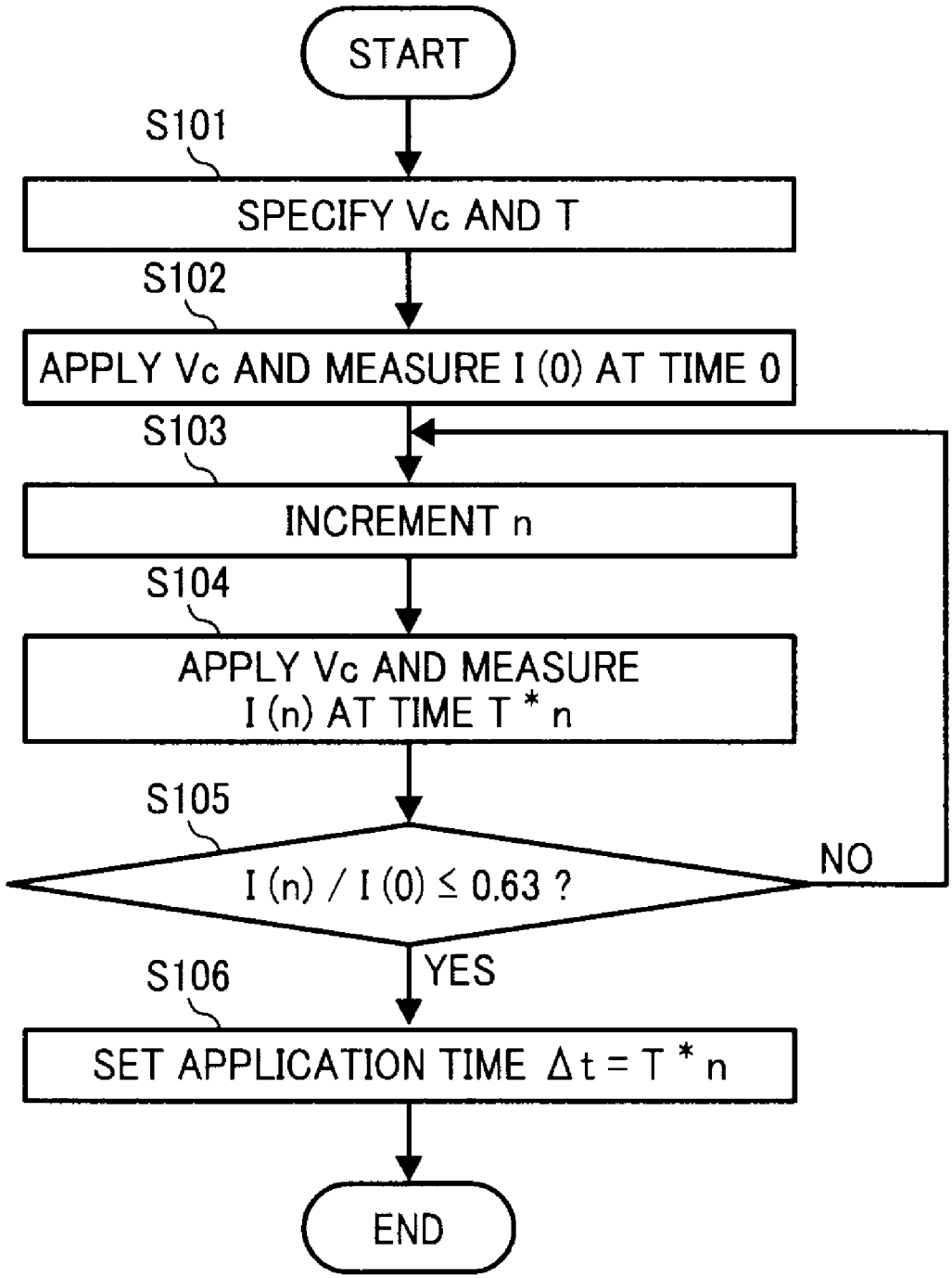
FIG. 15 is a flowchart illustrating adjustment of application time in the transfer bias optimizer according to this patent specification.

FIG. 15 is a flowchart illustrating adjustment of the application time Δt in the transfer bias optimizer TBO according to this patent specification.

First, the operation accesses memory to read out a given constant voltage Vc in volts and a given time interval T in microseconds to initiate application time adjustment (step S101).

Upon initiation, the voltage applicator 31 starts applying the voltage Vc to the transfer roller, while the current sensor 32 measures and stores a value of first current I(0) flowing into the transfer roller at 0 μs after starting the voltage application (step S102).

When the interval T has elapsed since the last current measurement, the variable n is incremented by one (step S103). The current sensor 32 then measures a current I(n) flowing into the transfer roller at T*n ps after starting the voltage application (step S104). For example, the current sensor 32 may take second and third current values I(1) and I(2) at T μs and at 2 T μs, respectively, after starting the voltage application.

Upon obtaining the (n+1)th current value I(n), the operation calculates a ratio of the latest value I(n) against the initial value I(0), and compares the ratio I(n)/I(0) against a time constant of 0.63 (step S105).

When I(n)/I(0)>0.63 ("NO" in step S105), the operation returns to step S103.

When I(n)/I(0)≦0.63 ("YES" in step S105), the operation completes by setting the application time Δt to T*n (step S106).

The application time Δt adjusted through the above operation is substantially equal to the time constant of the current sensor 32, a period of a millisecond or so during which the sensed current rises to a peak and starts declining upon stepping of the applied voltage (see FIG. 3). That is, the application time Δt is sufficient for the discharge detector 34 to determine the rate of increase of the sensed current.

Preferably, the application time Δt may be reset using the above procedure after replacement of components involved in transfer process, such as the primary transfer roller, the photoconductor drum, and/or the intermediate transfer belt, or upon significant changes in environmental conditions in which the image forming apparatus is operated. With the application time Δt properly adjusted, the image forming apparatus can set the bias voltage Vbias through test voltage application in a reliable, efficient manner without requiring undue time to measure current at each voltage step.

Thus, the image forming apparatus incorporating the transfer bias optimizer TBO according to this patent specification can effectively optimize a transfer bias to provide a high transfer rate while preventing electrical discharges in transferring toner images across a transfer gap.

In certain embodiments, e.g., those depicted in FIG. 5, 6, or 11, the transfer bias optimizer TBO may modify the transfer bias using an aging coefficient of developer in use, accounting for the fact that the quality of developer deteriorates over time through repeated use in developing toner images. In such cases, different aging coefficients may be calculated in advance for different deterioration levels, so that a suitable value is selected upon completion of a given number of print cycles.

Additionally, the term "transfer member" as used herein refers to any device, such as a roller, a brush, or a corona charger, that can develop a transfer field when provided with a transfer bias, and the term "recording sheet" herein refers to any sheet or film material, such as a paper sheet, a transparency, etc., onto which a final image is transferred to be permanently fixed.

As well, the term "intermediate transfer substrate" herein refers to any device, such as a cylinder or a belt, having an outer, imaging surface onto which a toner image is transferred from a photoconductor before transfer to a recording sheet, and the term "transport substrate" herein refers to any device, such as a cylinder or a belt, having an endless outer surface to transport a recording sheet thereon.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

a transfer device to transfer a toner image from one surface to another by developing an electrical field across a transfer gap when provided with a transfer bias;

a voltage applicator to apply a stepped test voltage, being a voltage increased in regular steps, to the transfer device;

a current sensor to sense a current flowing to the transfer device during application of the test voltage; and a discharge detector to detect an electrical discharge occurring in the transfer gap based on a rate of increase of the sensed current.

2. The image forming apparatus according to claim 1, further comprising a bias controller to set the transfer bias to an optimum voltage that when applied does not induce an electrical discharge in the transfer gap during test voltage application.

3. The image forming apparatus according to claim 2, wherein the optimum voltage is one step lower than a voltage initially inducing an electrical discharge in the transfer gap during test voltage application.

4. The image forming apparatus according to claim 2, further comprising:

multiple imaging stations, each including:

a photoconductor having a photoconductive surface to form a toner image thereon; and the transfer device defining the transfer gap between a primary transfer member and the photoconductor; and an intermediate transfer substrate having an imaging surface passing through the multiple transfer gaps, the multiple transfer devices transferring the multiple toner images from the photoconductive surfaces to the imaging surface to form a multicolor, composite image.

5. The image forming apparatus according to claim 2, further comprising:

multiple imaging stations, each including:

a photoconductor having a photoconductive surface to form a toner image thereon; and the transfer device defining the transfer gap between a direct transfer member and the photoconductor; and a transport substrate to pass a recording sheet through the multiple transfer gaps, the multiple transfer devices transferring the multiple toner images from the photoconductive surfaces to the recording sheet to form a multicolor, composite image.

6. The image forming apparatus according to claim 5, wherein the bias controller modifies the transfer bias according to a type of recording sheet in use.

7. The image forming apparatus according to claim 6, wherein the modified transfer bias is obtained by adding a corrective voltage to the optimum voltage, the corrective voltage being a product of a given correction value dependent on the type of recording sheet and a current flowing with the optimum voltage during test voltage application.

8. The image forming apparatus according to claim 7, wherein the bias controller comprises a selector that selects the sheet-dependent correction value from multiple correction values for different types of recording sheets to be used with the transfer device.

9. The image forming apparatus according to claim 7, further comprising:

a biasing member to face the transport substrate at a measuring point upstream of the transfer gap;

a constant voltage applicator to apply a given constant voltage to the biasing member as the recoding sheet passes the measuring point; and a current detector to detect a current flowing into the biasing member upon application of the given constant voltage, wherein the bias controller calculates the sheet-dependent correction value as a ratio of the given constant voltage to the detected current.

10. The image forming apparatus according to claim 9, wherein the bias controller determines the optimum voltage prior to, or simultaneously with, calculation of the sheet-dependent correction value, and obtains the modified transfer bias before the recording sheet reaches the transfer gap.

11. The image forming apparatus according to claim 1, further comprising a bias controller to set the transfer bias to a current flowing with an optimum voltage that when applied does not induce an electrical discharge in the transfer gap during test voltage application.

12. The image forming apparatus according to claim 11, wherein the optimum voltage is one step lower than a voltage initially inducing an electrical discharge in the transfer gap during test voltage application.

13. The image forming apparatus according to claim 1, wherein the stepped test voltage remains unchanged during a set application time sufficient for the discharge detector to determine the rate of increase of the sensed current.

14. A method for setting a transfer bias provided to a transfer device to develop an electrical field across a transfer gap, the method comprising:

applying a stepped test voltage, being a voltage increased in regular steps, to the transfer device;

sensing a current flowing to the transfer device during application of the test voltage;

detecting an electrical discharge occurring in the transfer gap based on a rate of increase of the sensed current; and setting the transfer bias to an optimum voltage that when applied does not induce an electrical discharge in the transfer gap during test voltage application.

15. The method according to claim 14, wherein the optimum voltage is one step lower than a voltage initially inducing an electrical discharge in the transfer gap during test voltage application.

16. The method according to claim 14, further comprising setting the transfer bias to a current flowing with an optimum voltage that when applied does not induce an electrical discharge in the transfer gap during test voltage application.

17. The method according to claim 16, wherein the optimum voltage is one step lower than a voltage initially inducing an electrical discharge in the transfer gap during test voltage application.

18. The method according to claim 14, further comprising modifying the transfer bias according to a type of recording sheet in use.

19. The method according to claim 14, wherein the stepped test voltage remains unchanged during a set application time sufficient to determine the rate of increase of the sensed current.

* * * * *